US007708651B2

(12) United States Patent
Shin

(10) Patent No.: US 7,708,651 B2
(45) Date of Patent: May 4, 2010

(54) GOLF PUTTER WITH AN ADJUSTABLE HANDLE AND A SHAFT THAT ROTATES ABOUT THE HANDLE AND METHOD FOR USING THE SAME

(76) Inventor: Hyung In Shin, 10111 Babbitt Ave., Northridge, CA (US) 91325

( * ) Notice: Subject to any disclaimer, the term of this patent is extended or adjusted under 35 U.S.C. 154(b) by 27 days.

(21) Appl. No.: 11/986,756

(22) Filed: Nov. 24, 2007

(65) Prior Publication Data

US 2009/0137337 A1 May 28, 2009

(51) Int. Cl.
*A63B 53/16* (2006.01)

(52) U.S. Cl. ..... 473/294; 473/295; 473/296

(58) Field of Classification Search ..... 473/293–295, 473/298–299, 296
See application file for complete search history.

(56) References Cited

U.S. PATENT DOCUMENTS

| | | | | | |
|---|---|---|---|---|---|
| 760,161 | A | * | 5/1904 | Smith | 473/294 |
| 1,616,377 | A | * | 2/1927 | Knight | 473/295 |
| 3,663,019 | A | | 5/1972 | Palotsee | |
| 3,874,668 | A | | 4/1975 | Flege | |
| 4,252,317 | A | * | 2/1981 | Vezina | 473/294 |
| 4,365,807 | A | * | 12/1982 | Melby | 473/295 |
| 4,655,459 | A | * | 4/1987 | Antonious | 473/338 |
| 4,815,740 | A | | 3/1989 | Williams et al. | |
| 4,819,944 | A | * | 4/1989 | Doane | 473/256 |
| 4,880,240 | A | * | 11/1989 | Lewis | 473/215 |
| 5,088,738 | A | * | 2/1992 | Mundt et al. | 473/206 |
| 5,188,361 | A | | 2/1993 | Coombe | |
| 5,328,185 | A | * | 7/1994 | Finnigan et al. | 473/294 |
| 5,520,392 | A | * | 5/1996 | Foresi et al. | 473/227 |
| 5,586,946 | A | * | 12/1996 | Haber et al. | 473/295 |
| 5,913,730 | A | * | 6/1999 | Johnson | 473/204 |
| 6,190,266 | B1 | * | 2/2001 | Pamias | 473/294 |
| 6,599,201 | B1 | * | 7/2003 | Grant | 473/256 |
| 6,773,362 | B1 | * | 8/2004 | Choi | 473/340 |
| 7,048,643 | B2 | * | 5/2006 | Welsh et al. | 473/293 |
| 7,150,685 | B1 | * | 12/2006 | Berokoff | 473/294 |
| 2005/0197201 | A1 | * | 9/2005 | Schoeninger | 473/300 |
| 2009/0011850 | A1 | * | 1/2009 | Stites et al. | 473/288 |

FOREIGN PATENT DOCUMENTS

| | | |
|---|---|---|
| KR | 10-2004-0015123 | 9/2005 |
| KR | 20-2006-0027902 | 8/2007 |

* cited by examiner

*Primary Examiner*—Stephen L. Blau

(57) ABSTRACT

An improved putter having an adjustable handle, shaft, and putter head. The adjustable handle is configured for a first position or a second position. The shaft is connected with the adjustable handle and configured to rotate about the handle. The putter head is connected with the shaft and configured to move in a pendulum motion as the shaft rotates about the handle. The adjustable handle can be placed at a first position such that the handle is substantially perpendicular with respect to the shaft. The adjustable handle can be placed at a second position such that the handle is positioned in a vertical or upright position so that the golfer can easily place the improved putter into the golf bag after putting. In the first position, the golfer can use the pendulum motion of the putter head to putt a golf ball into the hole. Because the pendulum motion provides a stable motion for a putter head, the putter head can strike a golf ball with a higher degree of accuracy by moving along a target line and not deviating from that line. The improved putter also has a slidable grip on the shaft that allows the golfer to have a free flowing putting stroke.

16 Claims, 27 Drawing Sheets

GOLF PUTTER WITH AN ADJUSTABLE HANDLE AND A SHAFT THAT ROTATES ABOUT THE HANDLE AND METHOD FOR USING THE SAME

FIELD

This invention relates generally to a golf club and, more particularly, to a golf putter with an adjustable handle and a shaft that rotates about the handle and method for using the same.

BACKGROUND

A common goal for golfers is to reduce the number of strokes to their golf game. Reducing putting strokes on the green, however, is a problem area for many golfers. To reduce putting strokes, manufacturers of putters have focused on different putter head designs to improve target accuracy. For example, manufacturers have placed one or more alignment lines or large white dots (which represent aligned golf balls) on the putter heads for targeting a golf ball towards a hole. These types of putters have a number of limitations. For instance, to obtain target accuracy, the golfer must maintain a stable target line throughout the putting stroke. This requires rigid positioning of the arms and hands during the putting motion. Often times, as the golfer moves the putter during the back swing, the putter head goes off the target line causing the golfer to push or pull the putt so that the golf ball goes right or left of the hole. Golfers also tend to lift their head during the putt leaving the putter face open and causing the golf ball to move off target.

Another putter disclosed in U.S. Pat. No. 5,188,361 disclosed a putter that allowed for a pendulum motion of the shaft for advanced play. This putter, however, was not designed to improve putting accuracy. For example, the handle is positioned vertically with the shaft and putter head, causing the golfer to hold the putter in an awkward position. When holding such a putter, a golfer's hands on the handle and shaft can obstruct the eyesight path to the putter head and golf ball. Such an obstruction impedes the golfer from aligning the golf ball properly when putting.

SUMMARY

The improved putter disclosed herein can overcome the disadvantages of prior putters. According to one aspect of the invention, a putter comprises an adjustable handle, shaft, and putter head. The adjustable handle is configured for a first position and a second position. The shaft is connected with the adjustable handle and configured to rotate about the handle. The putter head is connected with the shaft and configured to move in a pendulum motion as the shaft rotates about the handle.

In another aspect of the invention, a putter comprises a handle, shaft, slidable grip, and a head. The shaft is connected with the handle and configured to pivot about the handle. The slidable grip is configured to slide along part of the shaft. The head is connected with the shaft and configured to move in a pendulum motion. For another aspect of the invention, a putter comprises a handle, shaft, and head. The shaft is connected with the handle. The handle is positioned substantially perpendicular with respect to the shaft. The head is connected with the shaft and configured to pivot about the handle to move the head in a pendulum motion.

In another aspect of the invention, a putter comprises a handle, shaft, slidable grip and a head. The shaft is connected with the handle. The slidable grip is attached to the shaft and configured to slide along parts of the shaft. The head is connected with the shaft. In still another aspect of the invention, a method is disclosed for using a putter having a adjustable handle, a shaft connected with the handle and configured to pivot about the handle, and a putting head connected with the shaft. For the method, the handle is adjusted such that the handle is positioned substantially perpendicular to the shaft. The shaft rotates about the handle in a first direction such that the putter head moves behind a golf ball. The shaft also rotates about the handle in a second direction such that the putter head strikes the golf ball.

BRIEF DESCRIPTION OF THE DRAWINGS

The accompanying drawings, which are incorporated in and constitute part of this specification, illustrate examples and exemplary embodiments of the invention, and together with the description, serve to explain the principles of the invention. In the drawings.

DETAILED DESCRIPTION

Reference will now be made in detail to the exemplary embodiments of the invention, examples of which are illustrated in the accompanying drawings. Wherever possible, the same reference numbers will be used throughout the drawings to refer to the same parts. The following examples disclose an improved putter and methods for using the same.

One example of the improved putter includes an adjustable handle, shaft, and putter head. The adjustable handle is configured for a first position and a second position. The shaft is connected with the adjustable handle and configured to rotate about the handle. The putter head is connected with the shaft and configured to move in a pendulum motion as the shaft rotates about the handle.

The handle can be substantially perpendicular to the shaft or at 90 degrees with respect to the shaft at the first position. In this position, a golfer can, e.g., use one hand to hold the handle at an end near his chest where the shaft is connected with the handle at the other end. The golfer can use the other hand to move and rotate the shaft about the other end of the handle. In this manner, the hand and arm positioning of the improved putter does not impede the eyesight path to the golf ball. Because the shaft can move in a pendulum motion and in a direction across an axis of the handle from its distal end to an end near the shaft, the putter head can strike a golf ball with a higher degree of accuracy by moving along a target line with greater stability. That is, the pendulum motion of the putter head for the improved putter provides a stable motion for the putter head to follow the target line without deviating from that line.

After putting the ball into the hole, the golfer can place the handle at a second position such that the handle is positioned in a vertical or upright position. This allows the golfer to easily place the improved putter into a golf bag. When the golfer uses the improved putter again, the handle can be adjusted to the first position where the handle is substantially perpendicular with respect to the shaft and putt the golf ball into the hole.

In another example, the improved putter includes a slidable grip that allows a golfer to move the shaft in a more free flowing manner. For instance, the golfer can grip the slidable grip with the index finger and thumb of one hand while the other hand is on the handle to easily move the shaft as it rotates about the handle. As the shaft moves, the sliding grip can slide up and down the shaft without requiring rigid hand and elbow positions throughout the putting motion. This allows the golfer to have a more free flowing movement of the arms and hands during the putting stroke. In alternative examples, the slidable grip can be used on conventional type putters to assist the golfer with the putting stroke. Exemplary embodiments of the improved putter will now be explained.

Figure 1A:
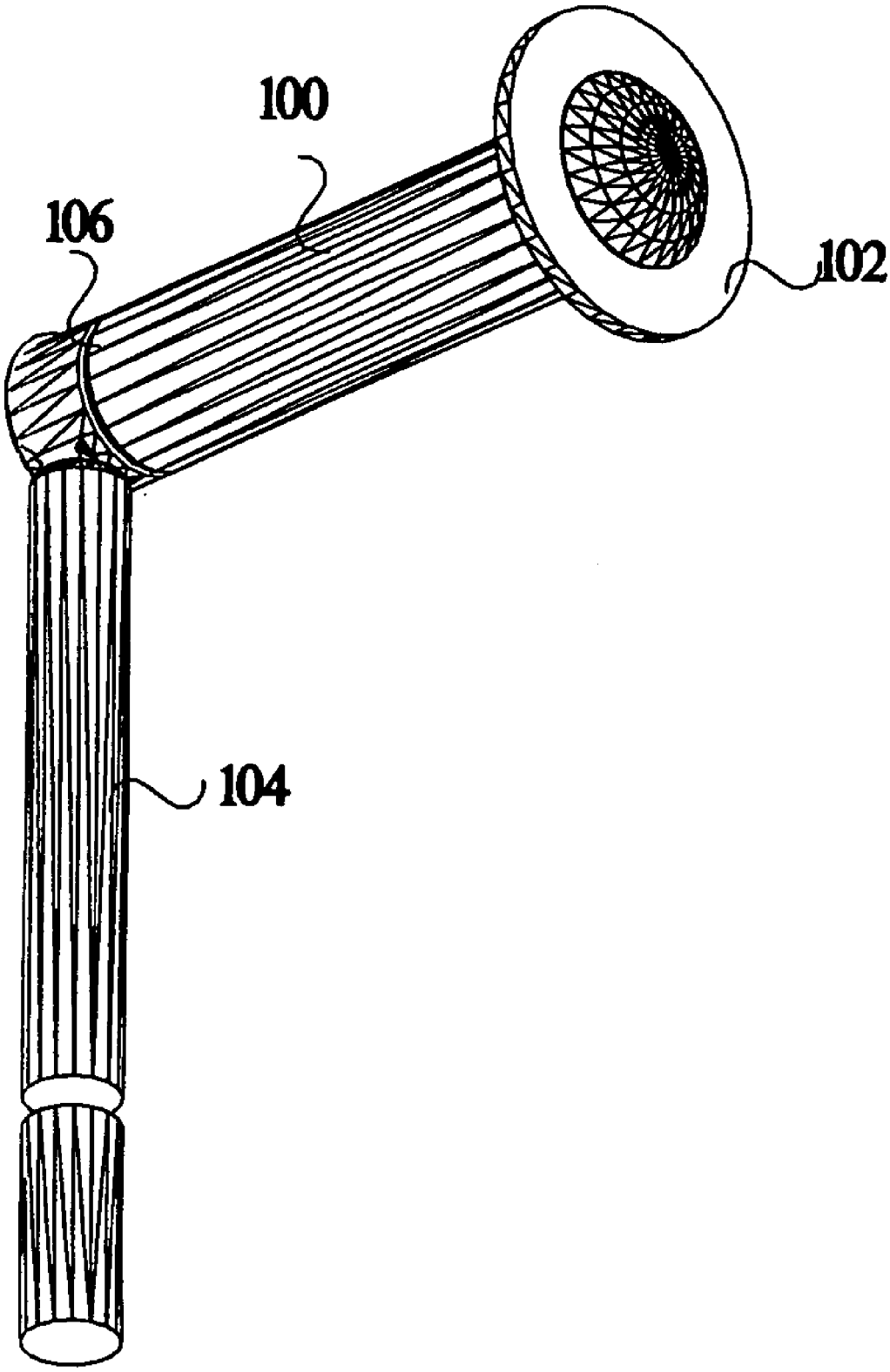
FIGS. 1A and 1B illustrate example perspective views of the handle and shaft of the improved putter.
Figure 1B:
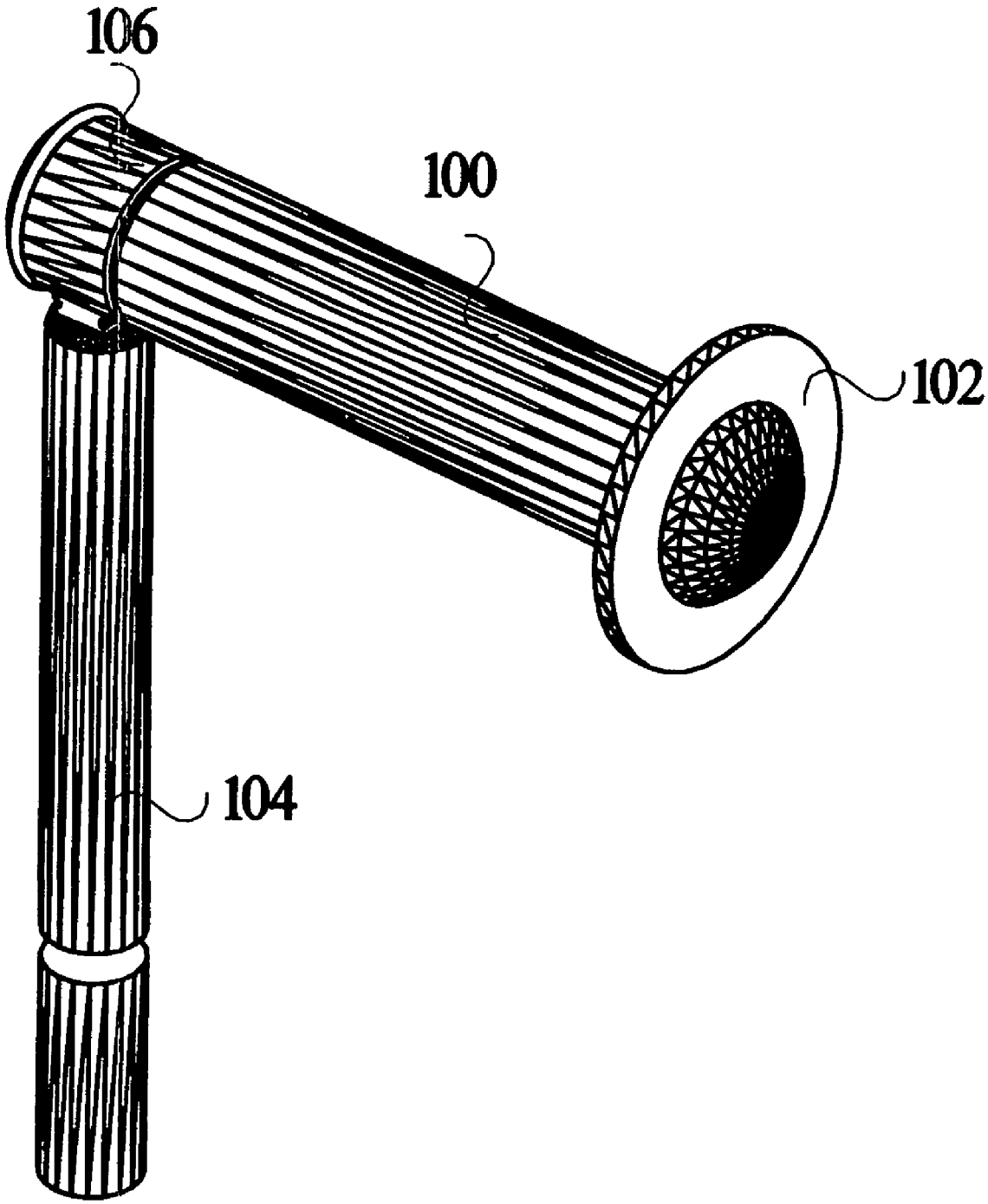

FIGS. 1A and 1B illustrate example perspective views of the handle 100 and shaft 106 of the improved putter. The shaft 104 includes a rotatable end 106 connected with the handle 100 that can rotate about the handle 100. The shaft 104 is shown as having a cut-off part, which is only to illustrate that it can continue in length as a solid piece. Within the rotatable end 106 is a pivoting mechanism (not shown) that allows the shaft 104 to rotate or pivot about the handle 100. In these examples, the handle 100 and shaft 104 are shown with a patterned covering of longitudinal triangles to provide a grip for a hand of the golfer. Examples of such coverings include soft or hard rubber, plastic, composite materials, or other gripping material. The covering is patterned to enhance gripping by a golfer, and can include any varying types of design patterns.

The handle 100 has a distal end with a circular disk 102 to maintain a golfer's grip on the handle 100. The rotatable end 106 of the shaft 104 has a circular ring shape to receive one end of the handle 100, the other end receives the circular disk 102. Examples of the pivoting mechanism within the rotatable ring 104 can include ball bearings rotating about a metal rod or cylinder within the handle 104 or a hinge such that shaft 104 can rotate or pivot about the handle 104. In these examples, the handle 100 should be positioned substantially perpendicular, i.e., at a 90 degrees angle, with respect to the shaft 104—tolerating several degrees above or below 90 degrees. The rotatable end 106 is configured to rotate about an end of the handle 100. Because the shaft 104 can rotate about the handle 100, the shaft 104 can swing like a pendulum. The shaft 104 swings in a direction orthogonal to an axis running from opposite ends of the handle 100. This pendulum motion provides an accurate way of striking the golf ball along a target line. Because the handle is positioned perpendicular to the shaft, a golfer can have one hand on the handle near the circular disk 102 so that the eyesight of the golfer is not impeded by the hand on the handle 100.

Figure 2:
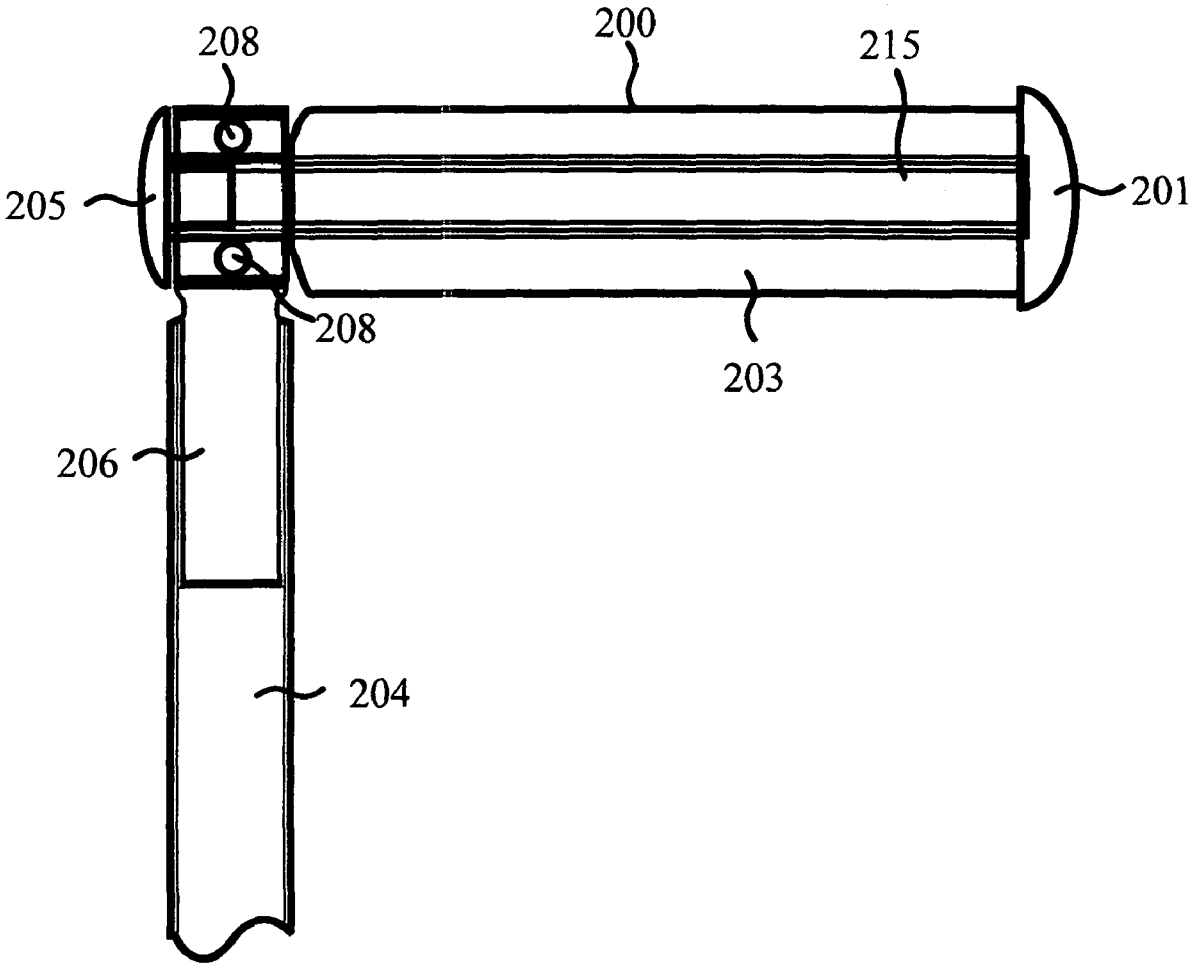
FIG. 2 illustrates one example side view of the components of the handle and shaft of the improved putter.

FIG. 2 illustrates one example side view of the components of the handle 200 and shaft 204 of the improved putter. This example can be implemented for the examples shown in FIGS. 1A and 1B. As shown, the handle 200 has a rounded end piece 201, which connects to a long cylindrical rod 215. The handle 200 can include an outer part 203, which can have a covering as shown in FIGS. 1A and 1B. Within the outer part 203, the long cylindrical rod 215 runs from the rounded end 201 to the rounded piece 205 connected to the rotatable end 206 of the shaft 204. The rod 215 is received by a circular ring of the rotatable end 206 and within the circular ring of the rotatable end 206 is a pivoting mechanism that includes ball bearings 208, which facilitate the rotating or pivoting motion of the shaft 204 about the handle 200. The pivoting mechanism for the improved putter is not limited to any particular mechanism and other alternatives can be implemented. For example, the shaft 204 can rotate about the handle 200 using a pivoting hinge or rod. In particular, the long cylindrical rod 215 can act as a pivoting hinge or rod in which the circular ring of the rotatable end 206 can attach to and allow the shaft 204 to rotate about the handle 200.

Figure 3:
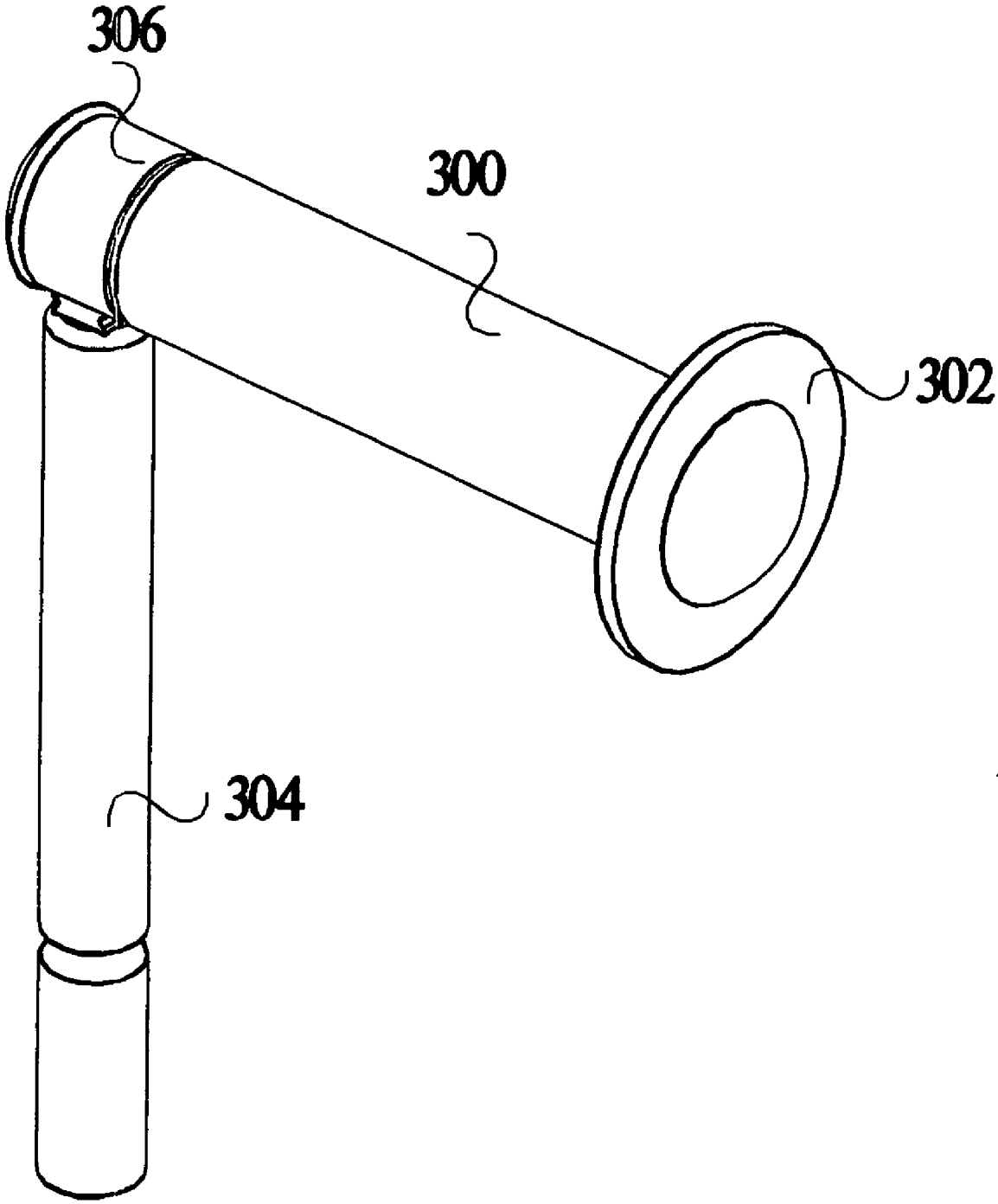
FIG. 3 illustrates another example perspective view of the handle and shaft of the improved putter with coverings removed.

FIG. 3 illustrates another example perspective of a handle 300 and shaft 304 of the improved putter with coverings removed. From this perspective, the handle 300 and shaft 304 can be composed of stainless steel. The circular disk 302 can also be composed of steel and soldered onto handle 300. Other examples of materials for the handle 300 and shaft 304 include titanium, graphite, aluminum, or other like materials.

Figure 4:
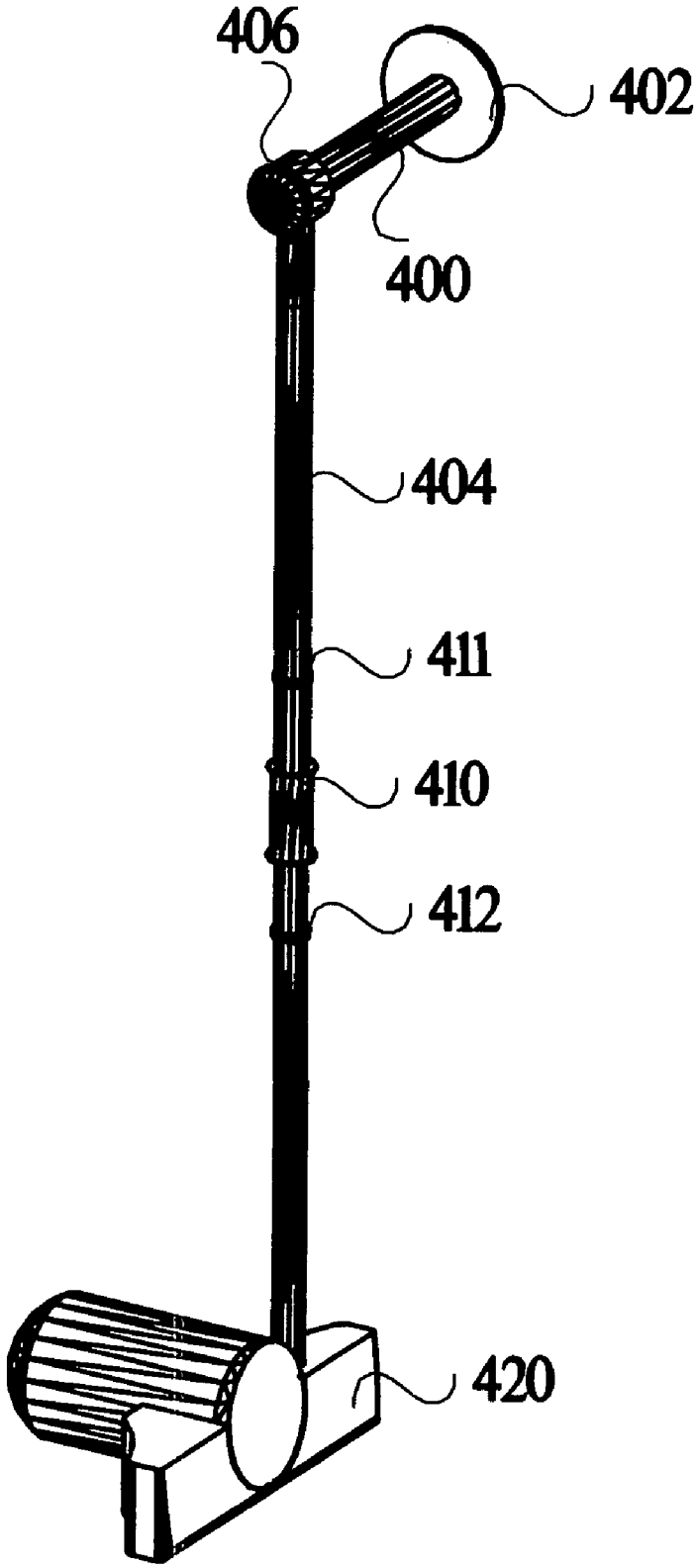
FIG. 4 illustrates one example perspective view of the improved putter.

FIG. 4 illustrates one example perspective view of the improved putter. Referring to FIG. 4, the improved putter includes a handle 400, shaft 404 that connects with the handle 400, and a putting head 420 that connects with the shaft 404. At one end, the shaft 404 includes a rotatable end 406 configured to rotate about the handle 400 and at the other end the shaft 404 is attached to the putting head 420. In this example, a slidable grip 420 is placed on shaft 404 and can slide or move along part of the shaft 404. The movement of the slidable grip 420 is limited in one direction by the upper stop part 411 and limited in another direction by the lower stop part 412. The upper and lower stop parts 411 and 412 can stop the movement of the slidable grip 420. Examples of the upper and lower stop parts 411 and 412 include rubber or plastic rings. These stop parts 411 and 412 are adjustable to accommodate a golfer's putting swing. For example, there can multiple screw holes along the shaft where the stop parts 411 and 412 can be attached. Alternatively, the stop parts can be composed of material such that they can easily be adjusted in position along the shaft 404—e.g., the shaft can have a thicker part where the stop parts can be fixedly placed at those locations, if made of a rubber or plastic having a diameter less than the diameter of the thicker part. In alternative examples, the slidable grip 410 and stop parts 411 and 412 can be placed on conventional type putters to assist the golfer with the putting stroke, and not limited to pivoting or rotating shaft type putters.

As can be seen from FIG. 4, a golfer can have one hand on the handle 402 which is positioned substantially perpendicular to the shaft 404 and another hand on the slidable grip 410. As the golfer moves the shaft 404 holding on the slidable grip 410 during the putting swing, the slidable grip 410 can move up and down the shaft between the top and bottom stop parts 411 and 412 to allow the golfer to have a more free flowing swing to an accurate putt without having to require rigid hand and arm positioning of conventional putters. Because the shaft 404 can rotate or pivot at the rotatable end 406, the putter head 420 moves in a pendulum motion that directs the putter head to move in a straight direction. This motion can prevent the putter head from moving off the target line and helping the golfer to avoid pushing and pulling the putt right and left of the golf hole.

In this example of FIG. 4, putter head 420 has a conical shape with a dome end to assist in the pendulum motion. The face of the putter head 420 can be flat and have the size of a golf ball to provide a solid contact with a golf ball and further alignment accuracy. This dome shape putter head 420 can provide a controlled weighting to provide a good feel to the putting swing when making contact with the golf ball. The putter head 420 for the improved putter can have any number of varying shapes and putter head faces and not limited to any design or shape. As long the putter head provides a face and a weight for the pendulum motion, putting accuracy by way of the pendulum motion can be achieved.

Figure 5A:
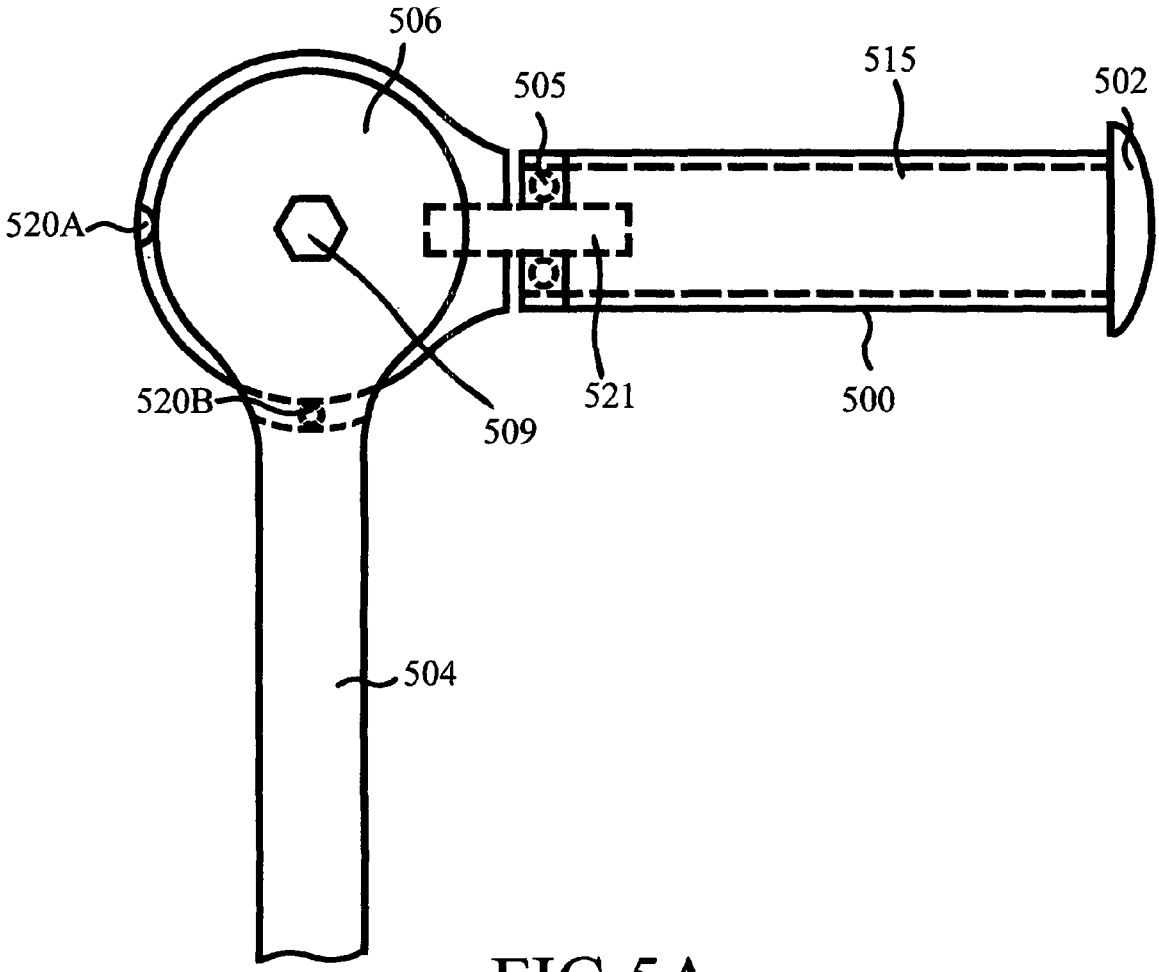
FIGS. 5A through 5C illustrate a side, front, and top views, respectively, of an adjustable handle and shaft of the improved putter.
Figure 5B:
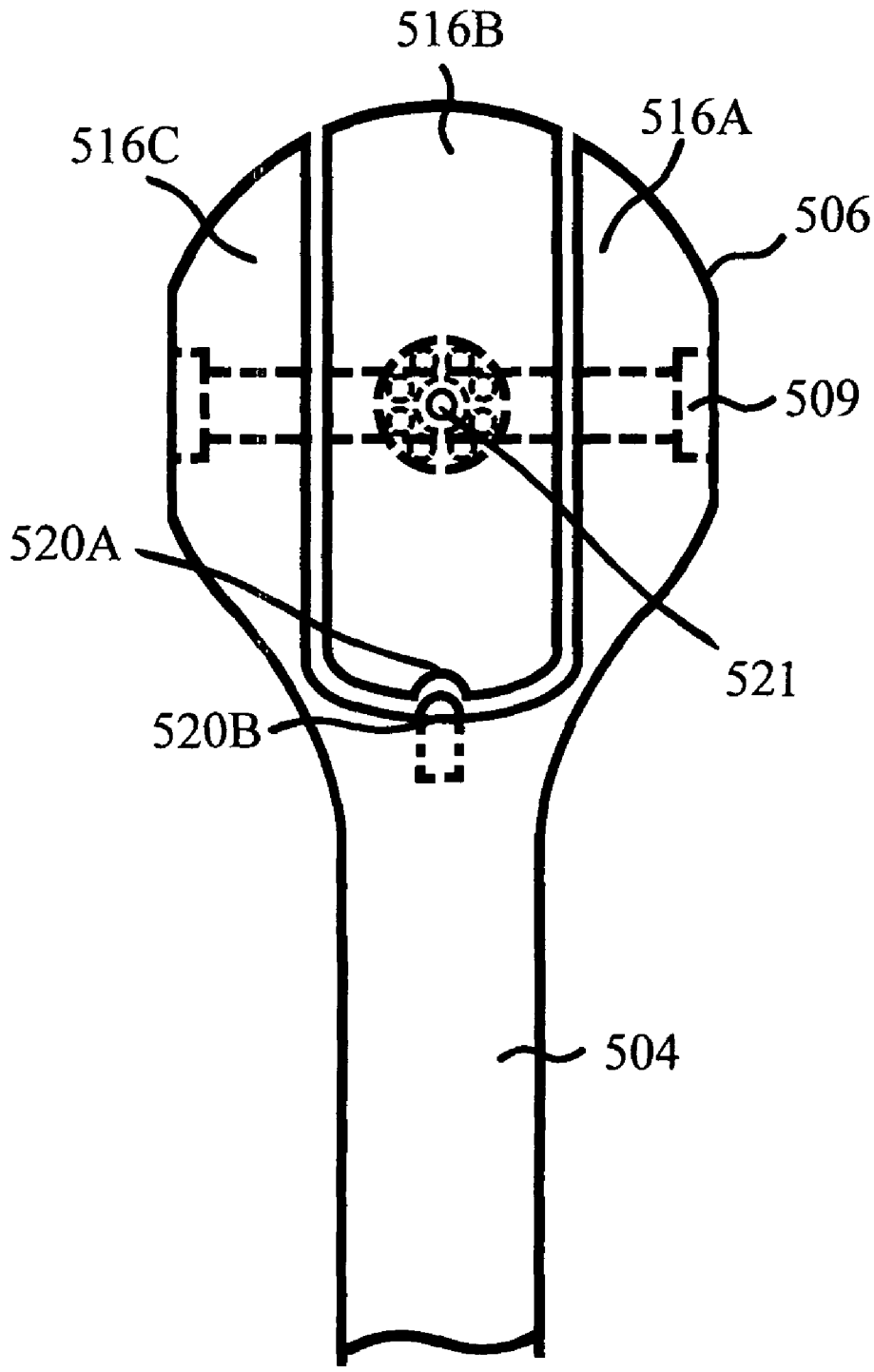
Figure 5C:
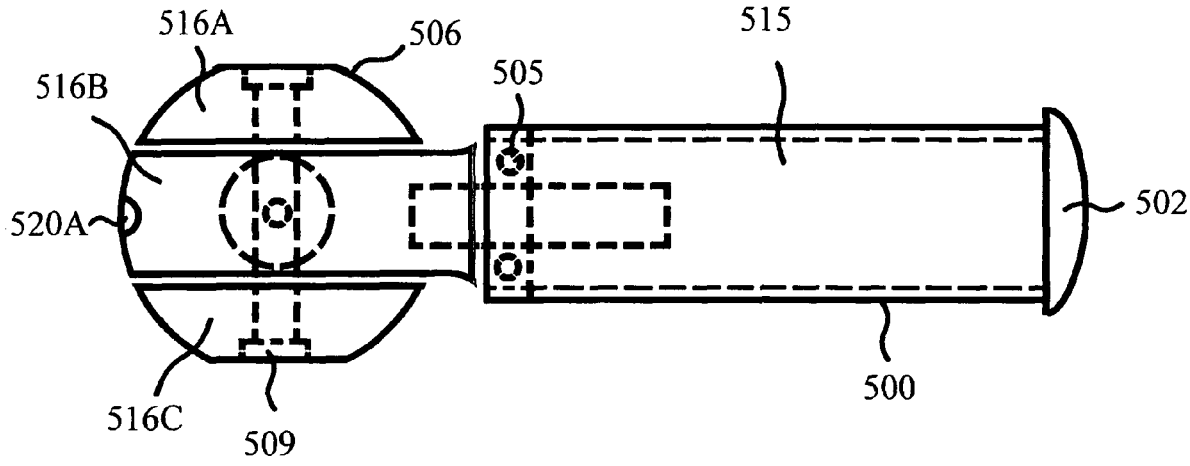

FIGS. 5A through 5C illustrate a side, front, and top views, respectively, of an adjustable handle 500 and shaft 504 of the improved putter. In these examples, for the adjustable handle 500, two pivoting points or mechanisms are provided to move the handle 500 from a perpendicular position with respect to the shaft 504 to a vertical position and to allow the shaft 504 to pivot about the handle 500 and provide a pendulum motion for hitting a golf ball.

Referring to FIG. 5A, the first pivoting mechanism to adjust the handle 500 into a vertical or upright position is shown by way of the bushing pin or rod 509 (rod 509) and ball shaped rotating end 506 for the shaft 504. Referring to FIG. 5B, the rotating end 506 includes three parts: two lateral parts 516A and 516C and a central part 516B between the lateral parts 516A and 516C. The rod 509 runs laterally from the lateral part 516C to the lateral part 516A and through the central part 516B. The handle 500 connects with the central part 516B by way of a connecting piece 521 that connects with the long rod 515 in the handle 500.

Referring to FIG. 5C, the handle 500, which is connected with the central part 516B, can pivot about the rod 509 (can act as a hinge) in the location of the dashed circle in the drawing. This allows the handle 500 to pivot or rotate to a vertical or upright position. For alternative examples, ball bearings can be implemented to rotate about the rod 509 and also allow the handle 500 to pivot into the vertical position. That is, the handle 500 pivots about the rod 509 at the pivoting point in the center portion of the central part 516B. Stop or locking mechanisms 520A and 520B are shown in FIGS. 5A and 5B that prevent the handle from going past the vertical or upright positions. For example, the locking mechanism can comprise of a button that when pressed in pushes in a tooth that can fit into a depression in the central part 516C when the button is released preventing the handle 500 from pivoting. The stopping mechanism 520A stops the handle 500 at the 90 degree position with respect to the shaft 504. The stopping mechanism 520B stops the handle 500 at 180 degree position with respect to the shaft 504. Other locking mechanisms can be implemented for the adjustable handle 500 and not limited to a particular example.

The second pivoting mechanism and pivoting point is shown by way of the ball bearings 505 in the handle 500. The rotating end 506 is connected with the shaft 504 and both can rotate about the handle 500 by way of the ball bearings 505. The ball bearings 505 can rotate around the connecting piece 521. This allows the shaft 504 to rotate or pivot about the handle 500 so that a putting head can have a pendulum motion when striking a golf ball. Although the pivoting mechanism includes ball bearings 505, other examples can be implemented such that the connecting piece 521 can act as a hinge to allow the shaft 504 to rotate about the handle 500.

Figure 6A:
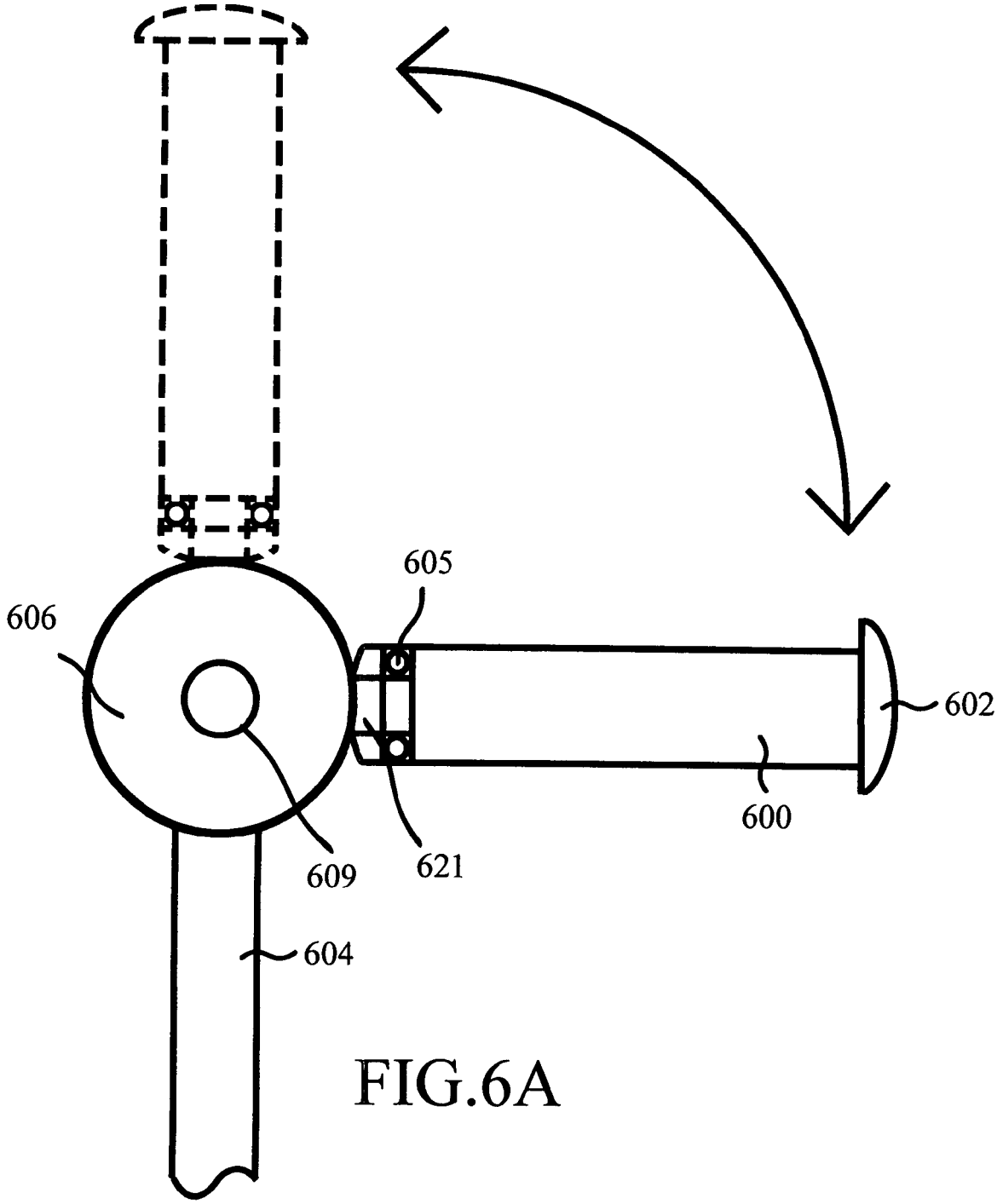
FIGS. 6A and 6B illustrate side views of the adjustable handle in a perpendicular and vertical position with respect to the shaft.
Figure 6B:
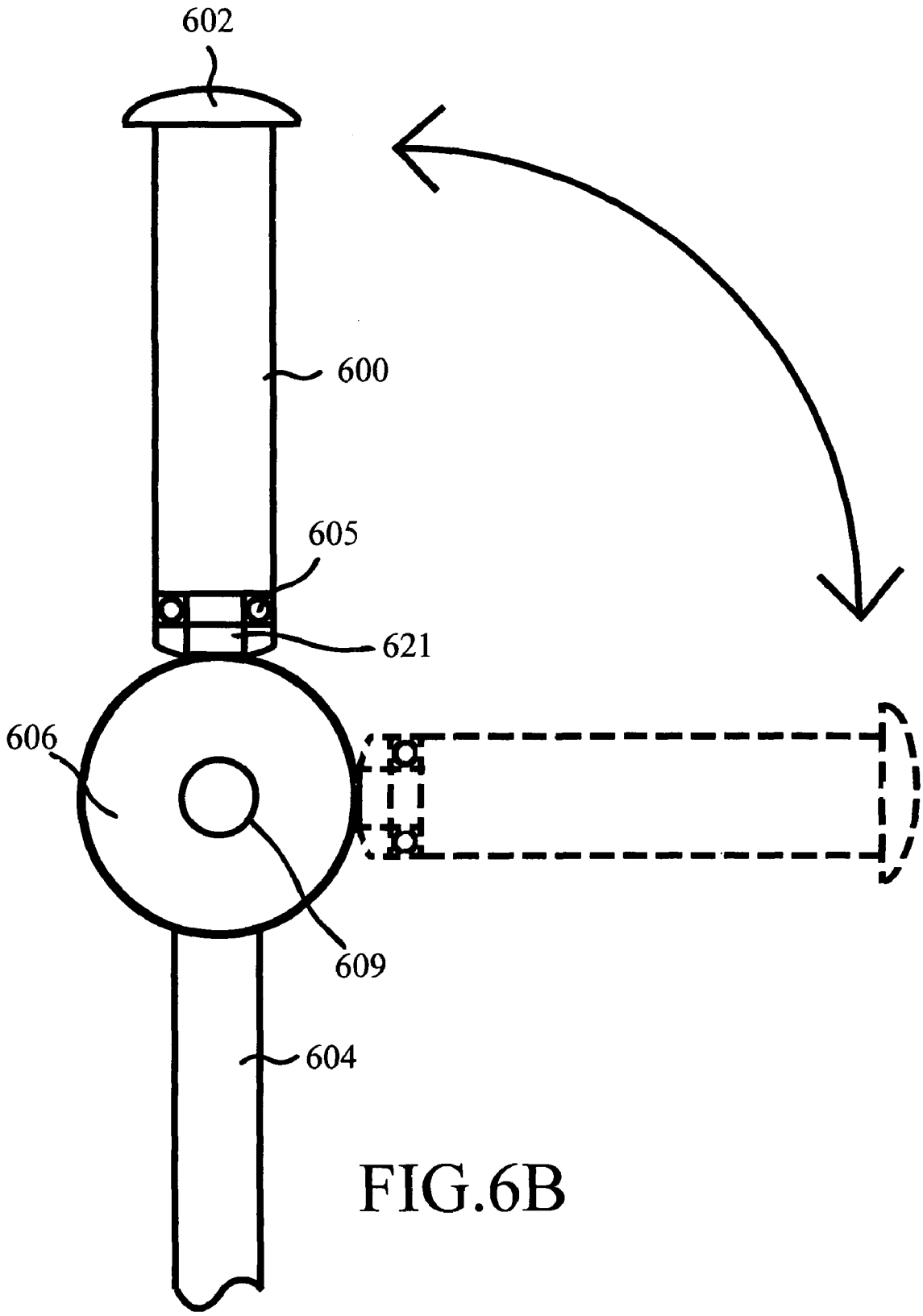

FIGS. 6A and 6B illustrate side views of the adjustable handle 600 in perpendicular and vertical positions, respectively, with respect to the shaft 604. Referring to FIG. 6A, the handle 600 is in a substantially perpendicular position with respect to the shaft 604. In this position, a golfer can use the improved putter to move the shaft 604 so it pivots about the handle 600 by way of the ball bearings 605 and connecting piece 621. After putting the golf ball into the hole, the golfer can adjust the handle 602 to a vertical or upright position as shown in FIG. 6B. In this position, the handle 600 can easily slide into the golf bag in contrast to when it is in a perpendicular position with the shaft 604. When the handle 600 is in the 180 degree position with respect to the shaft 604, the golfer can still use the improved putter in a conventional way.

FIGS. 7A through 7D illustrate example three-dimensional perspective views of the adjustable handle 700 in a perpendicular position with respect to the shaft 704 of the improved putter. These examples shown in FIGS. 5A-5D can be implemented in FIGS. 7A-7D, which are three-dimensional illustrations.

Figure 7A:
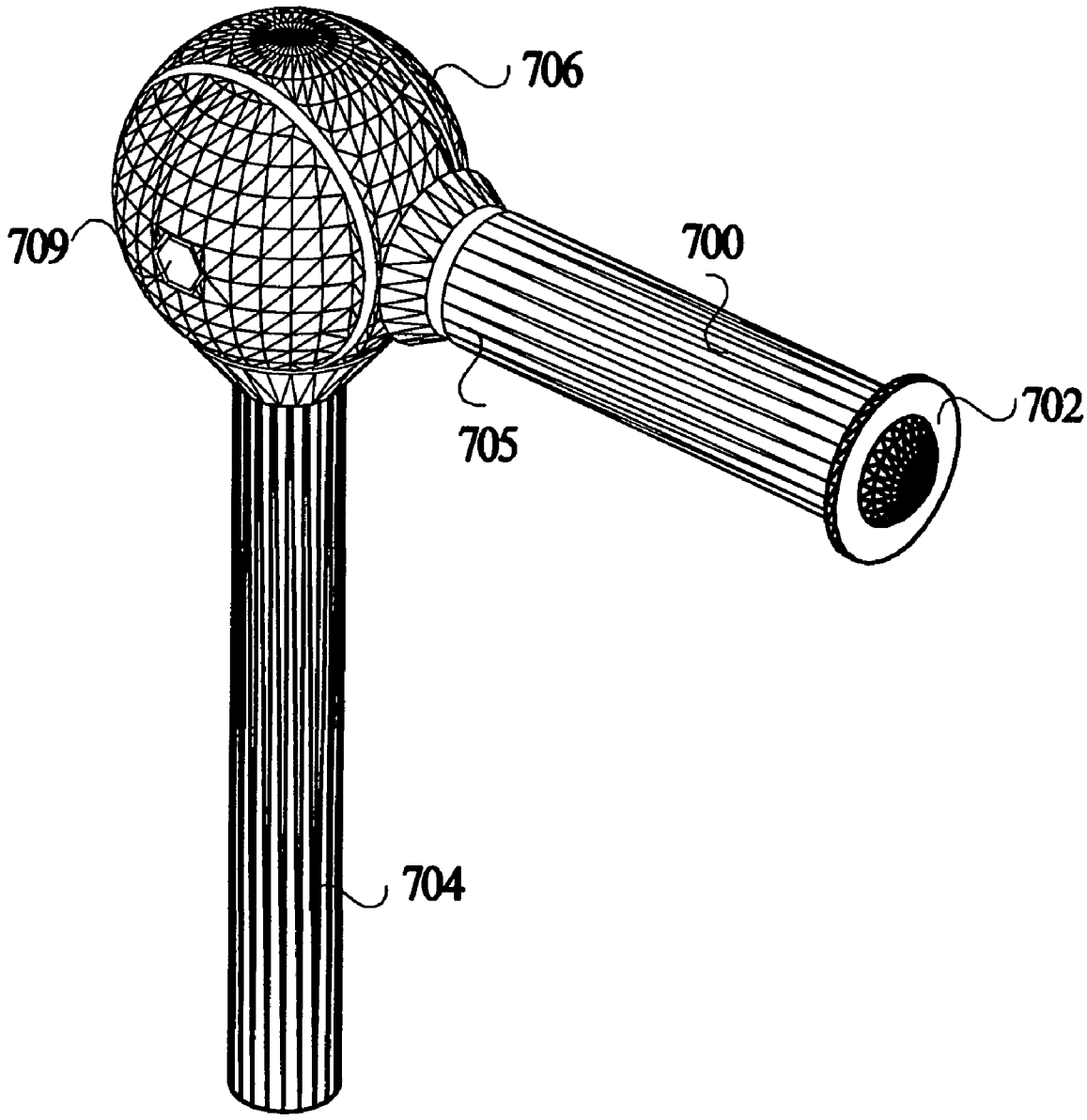
FIGS. 7A through 7D illustrate example three-dimensional perspective views of the adjustable handle in a perpendicular position with respect to the shaft of the improved putter.
Figure 7B:
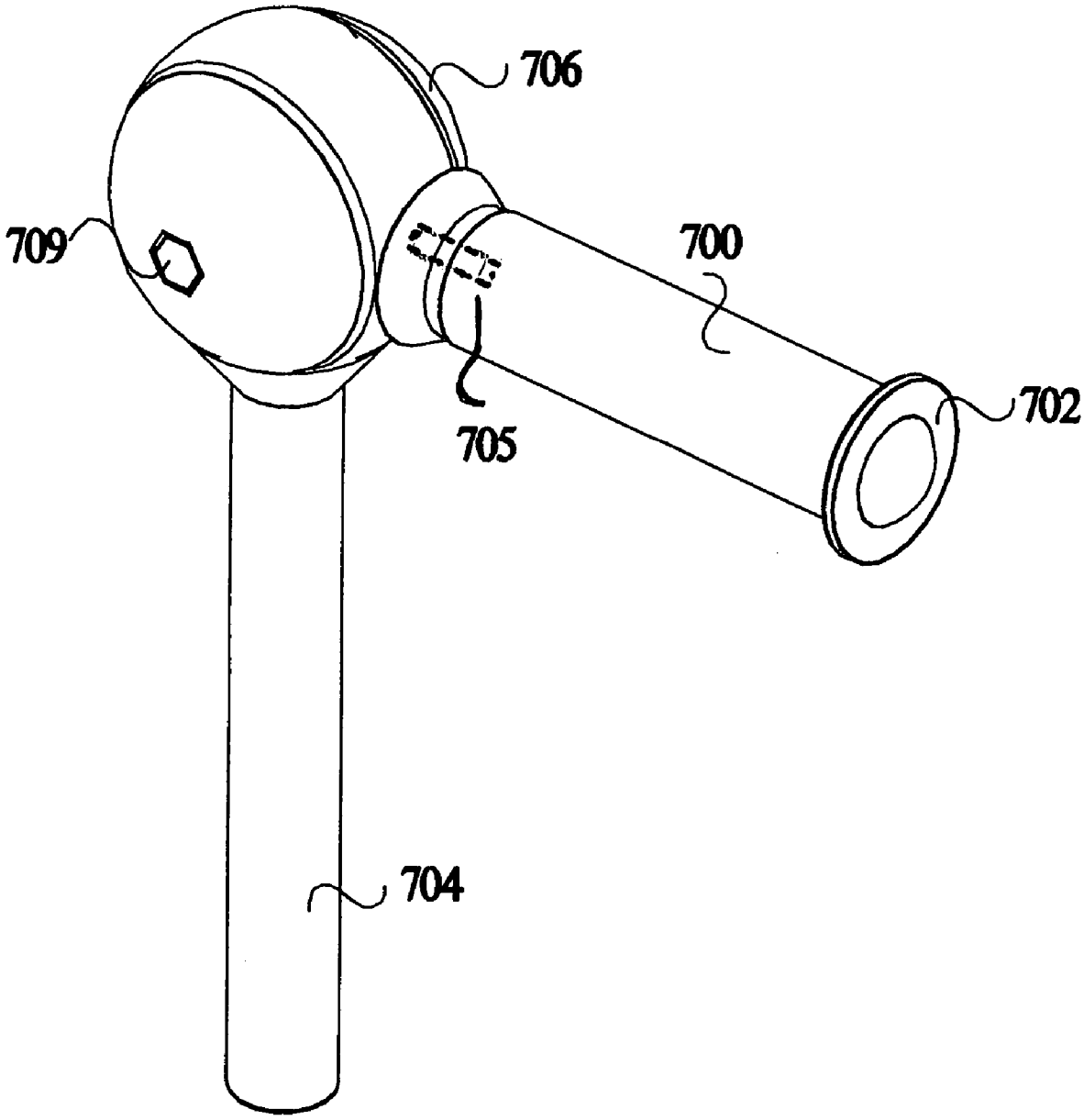
Figure 7C:
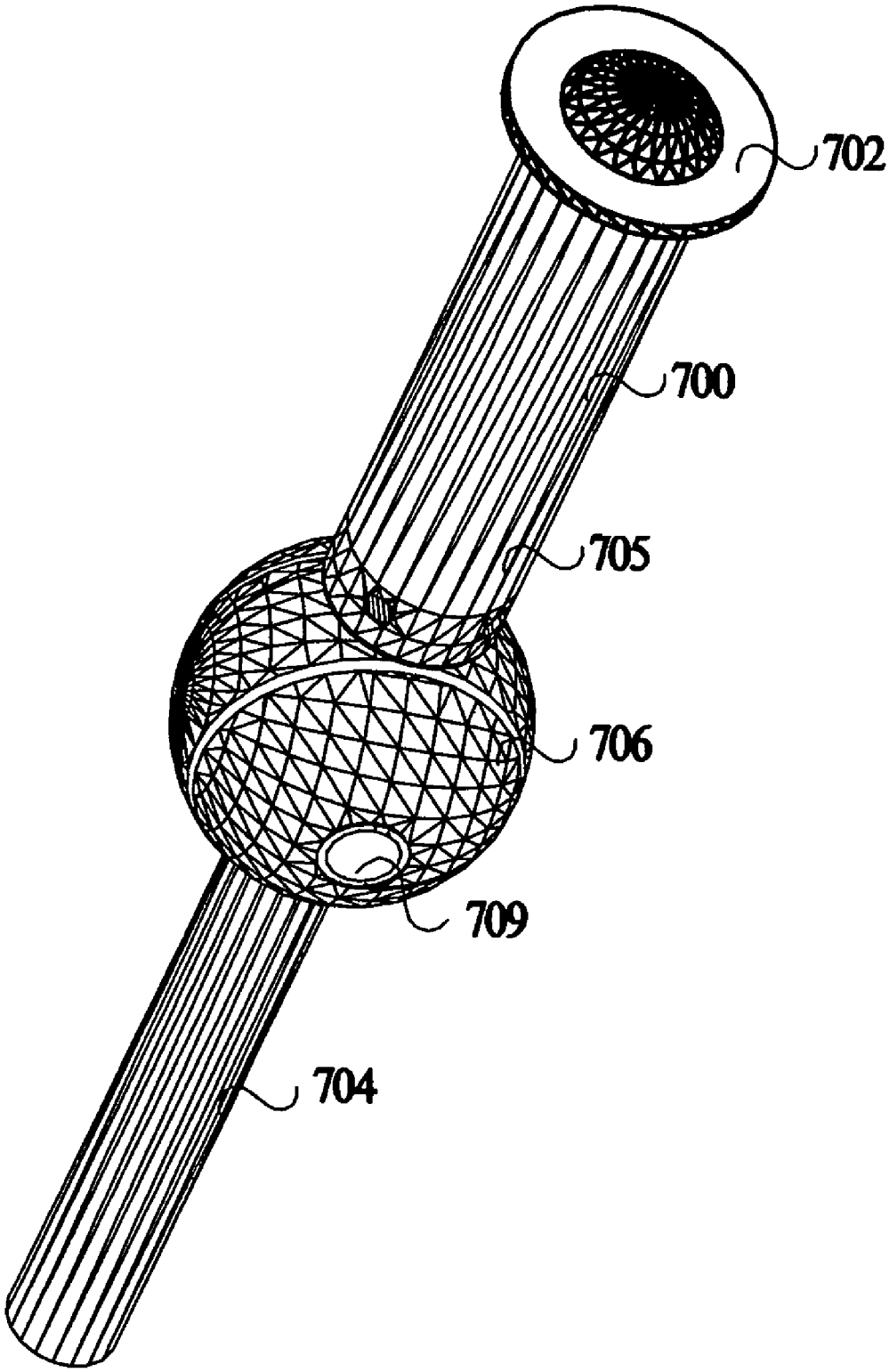
Figure 7D:
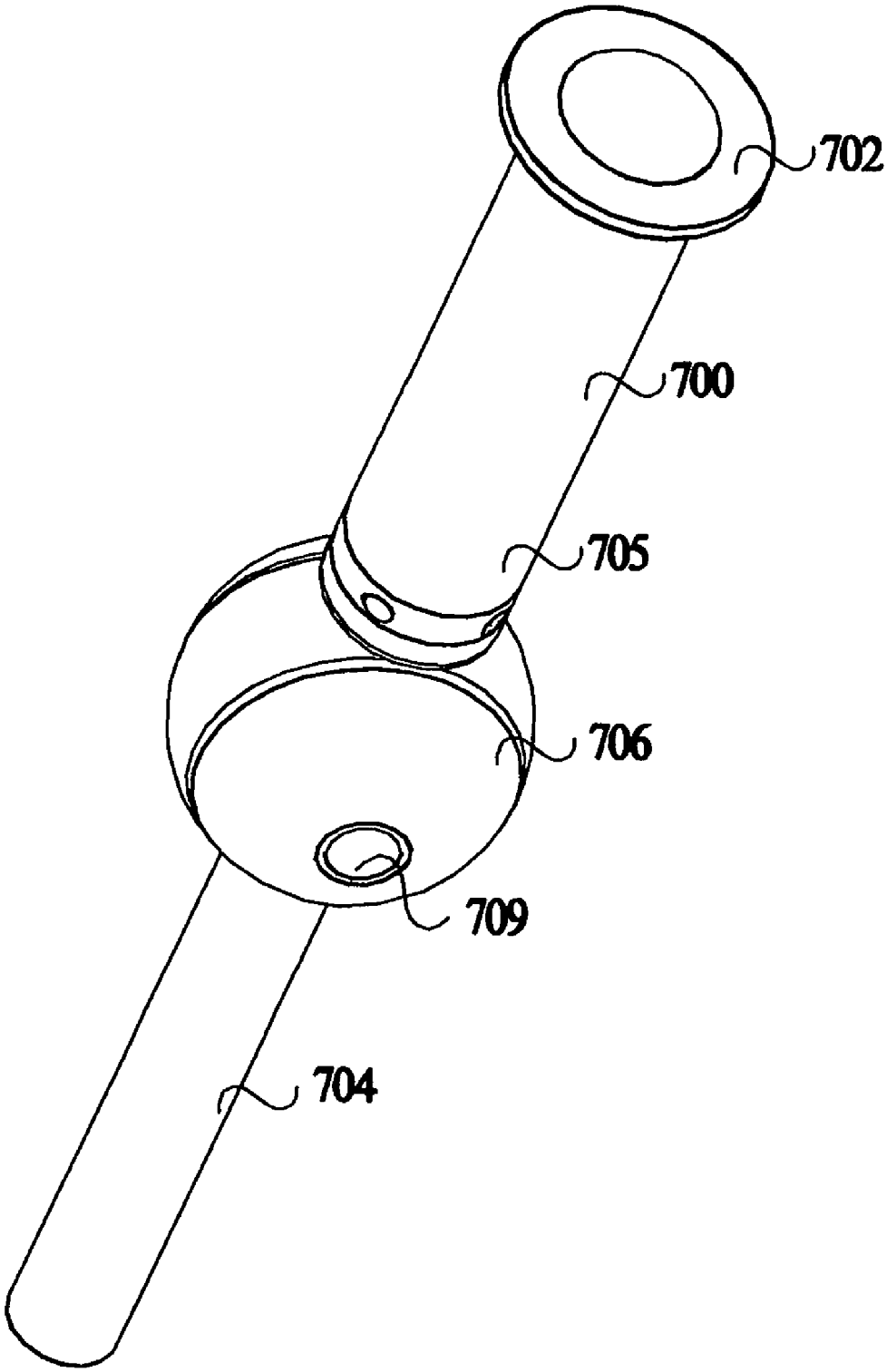

Because the handle 700 can pivot at the center part of the ball shaped rotating end 706, the handle 700 can be positioned in a vertical and upright position with respect to the shaft 704. This is necessary so that the improved putter can easily fit in a golfing bag. Alternatively, a golfer can use the improved putter where the handle 700 is in the upright position and use a conventional putting stroke. The improved putter, however, provides a second pivoting mechanism and pivoting point such that the shaft 704 can rotate about the handle 700 and allow a putting head to have a pendulum motion when striking a golf ball. For example, referring to the above FIGS. 7A-5D, the handle 700 includes a first pivoting mechanism 709 and second pivoting mechanism 705. The first pivoting mechanism allows the handle 700 to be adjusted to the upright position as shown in FIGS. 7C and 7D. The second pivoting mechanism 705 allows the shaft 704 to rotate about the handle 700 as shown in FIGS. 7A and 7B. FIGS. 7A and 7C show the adjustable handle 700 and shaft 704 with a protective covering and FIGS. 7B and 7D shown the handle 700 and shaft 704 without a covering. The improved putter could be used with or without coverings.

Figure 8A:
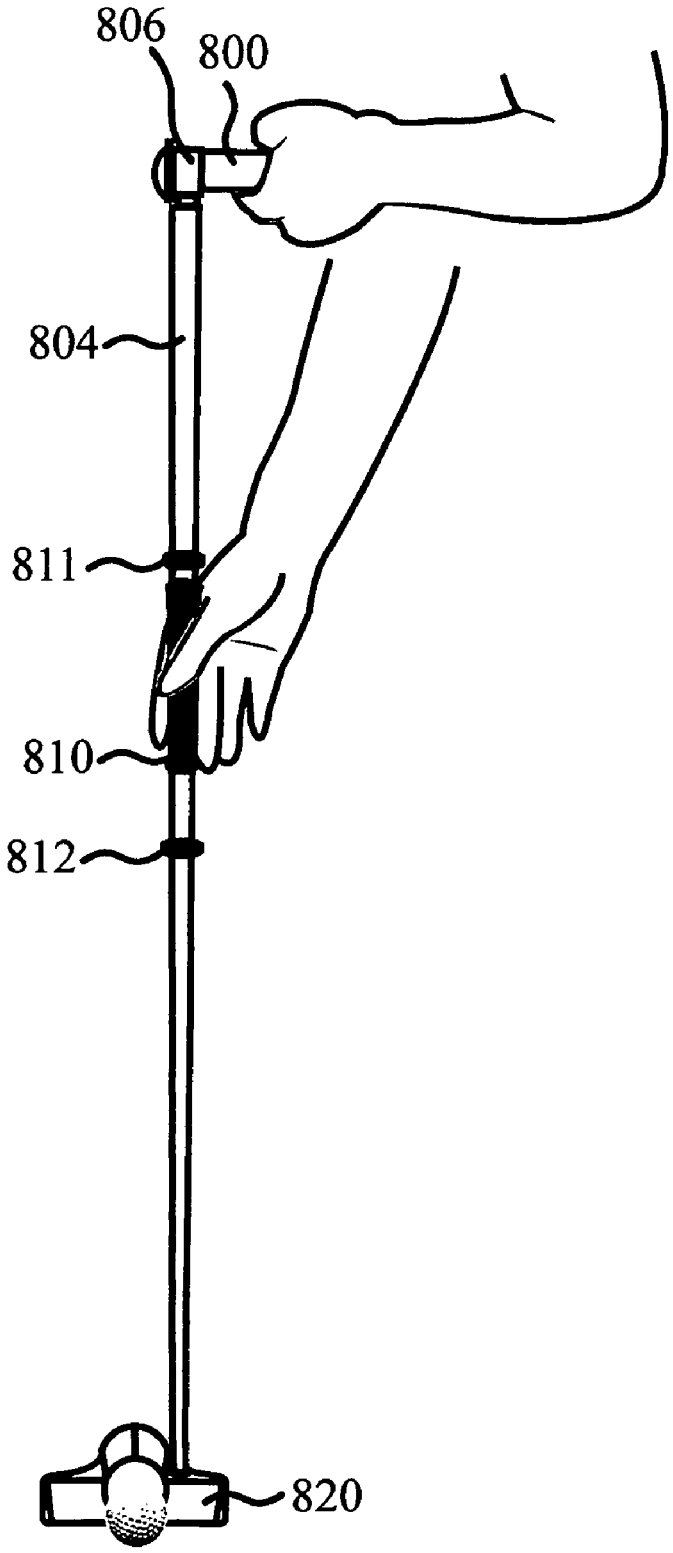
FIGS. 8A and 8B illustrates example front and back views, respectively, of a golfer holding the improved putter when aligning the putter head with the golf ball.
Figure 8B:
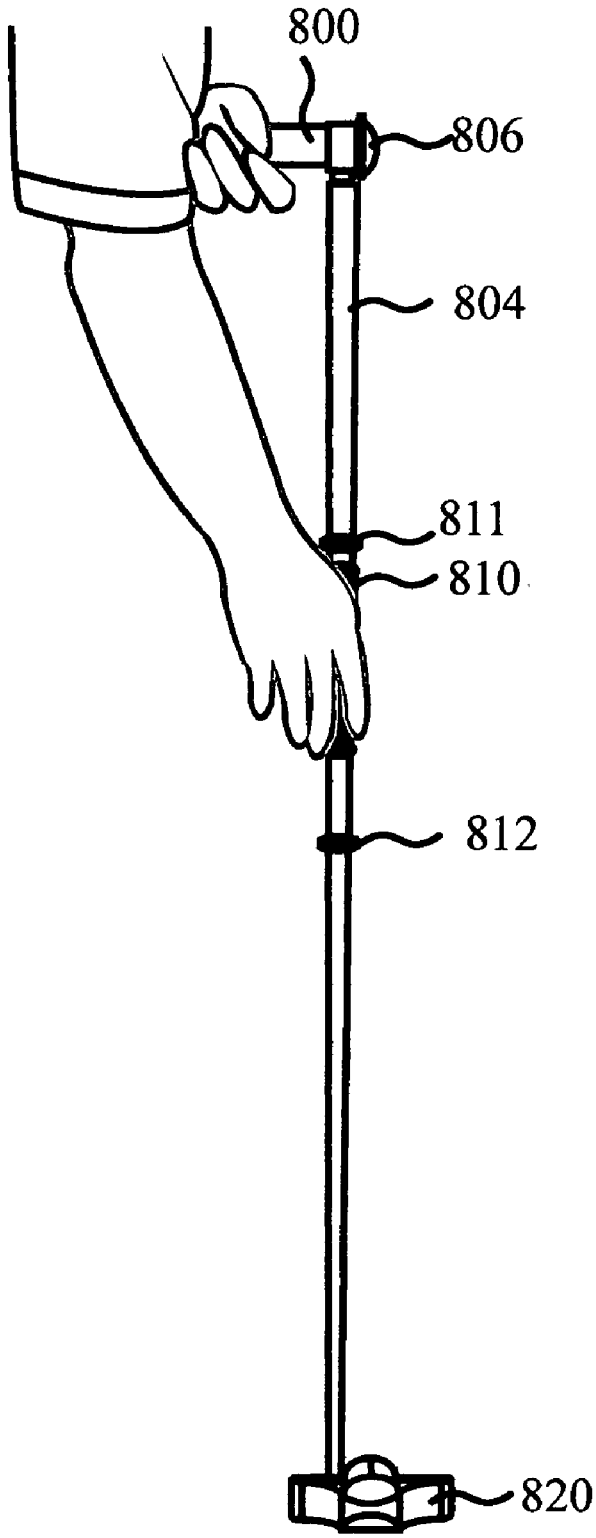

FIGS. 8A and 8B illustrates example front and back views, respectively, of a golfer holding the improved putter when aligning the putter head 820 with the golf ball. In these examples, the golfer holds one hand at the end of the handle 800 and another hand on the slidable grip 810. For the slidable grip, the index finger and thumb can control movement of the shaft. The putter head also has an alignment marking with a line going across the putter head from the face to the end of the putter head.

Figure 9A:
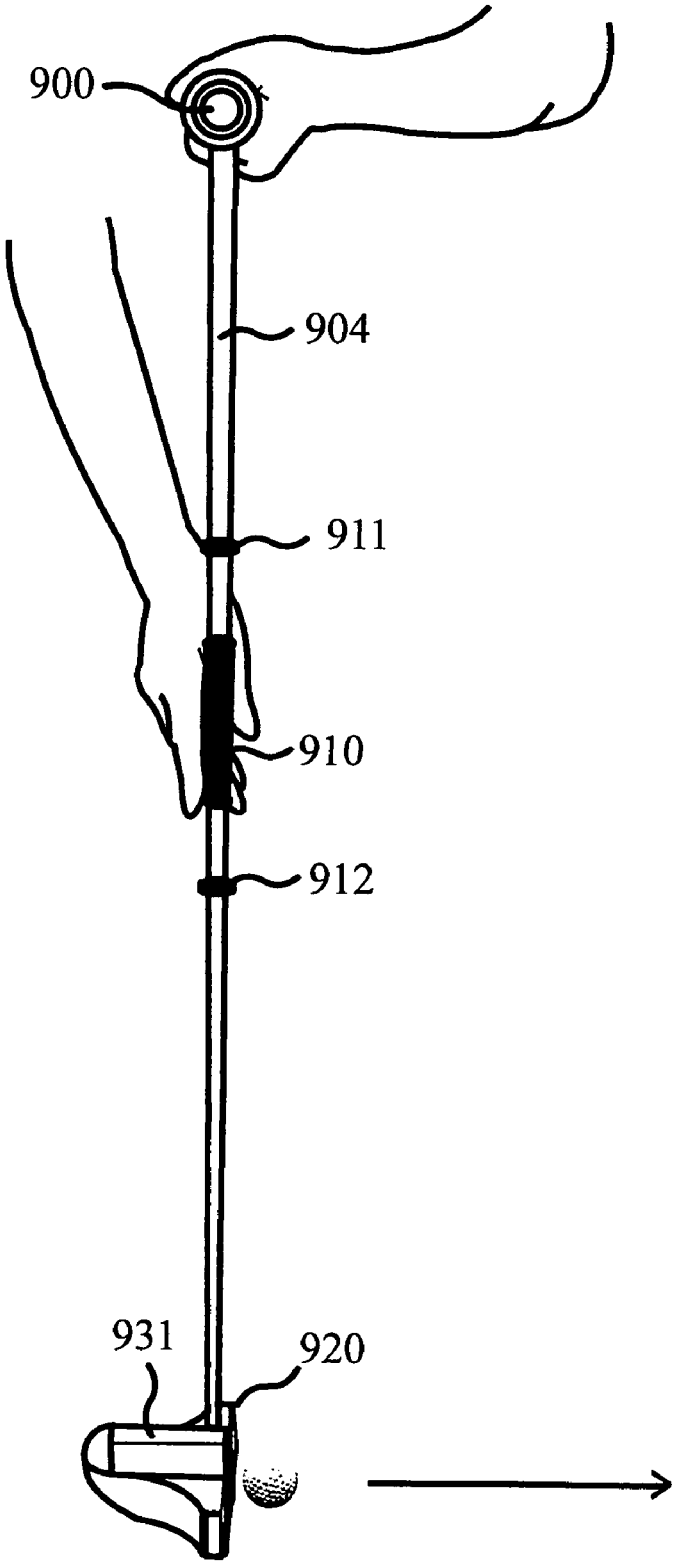
FIGS. 9A through 9C illustrate exemplary views of a golfer using the improved putter.
Figure 9B:
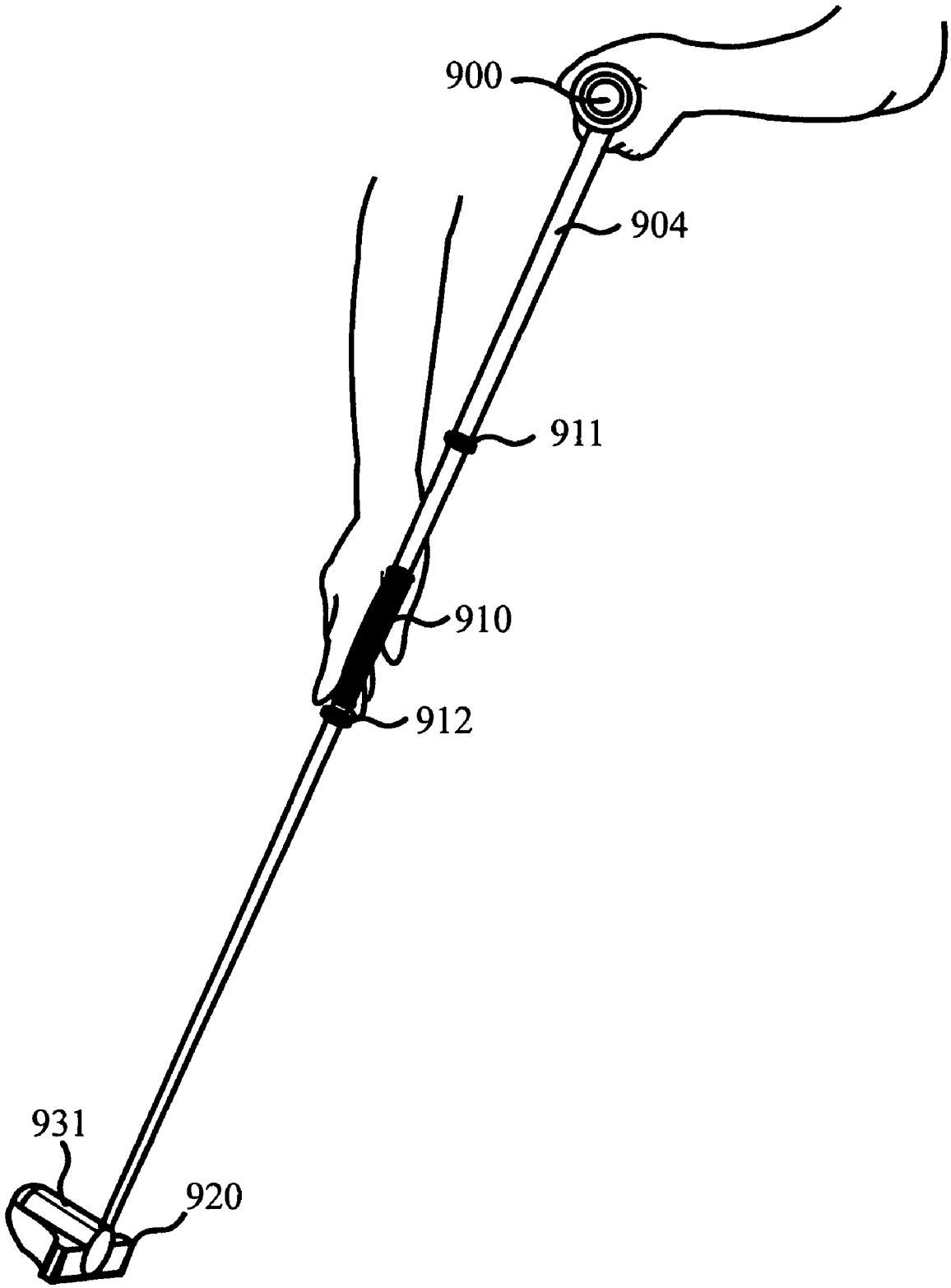
Figure 9C:
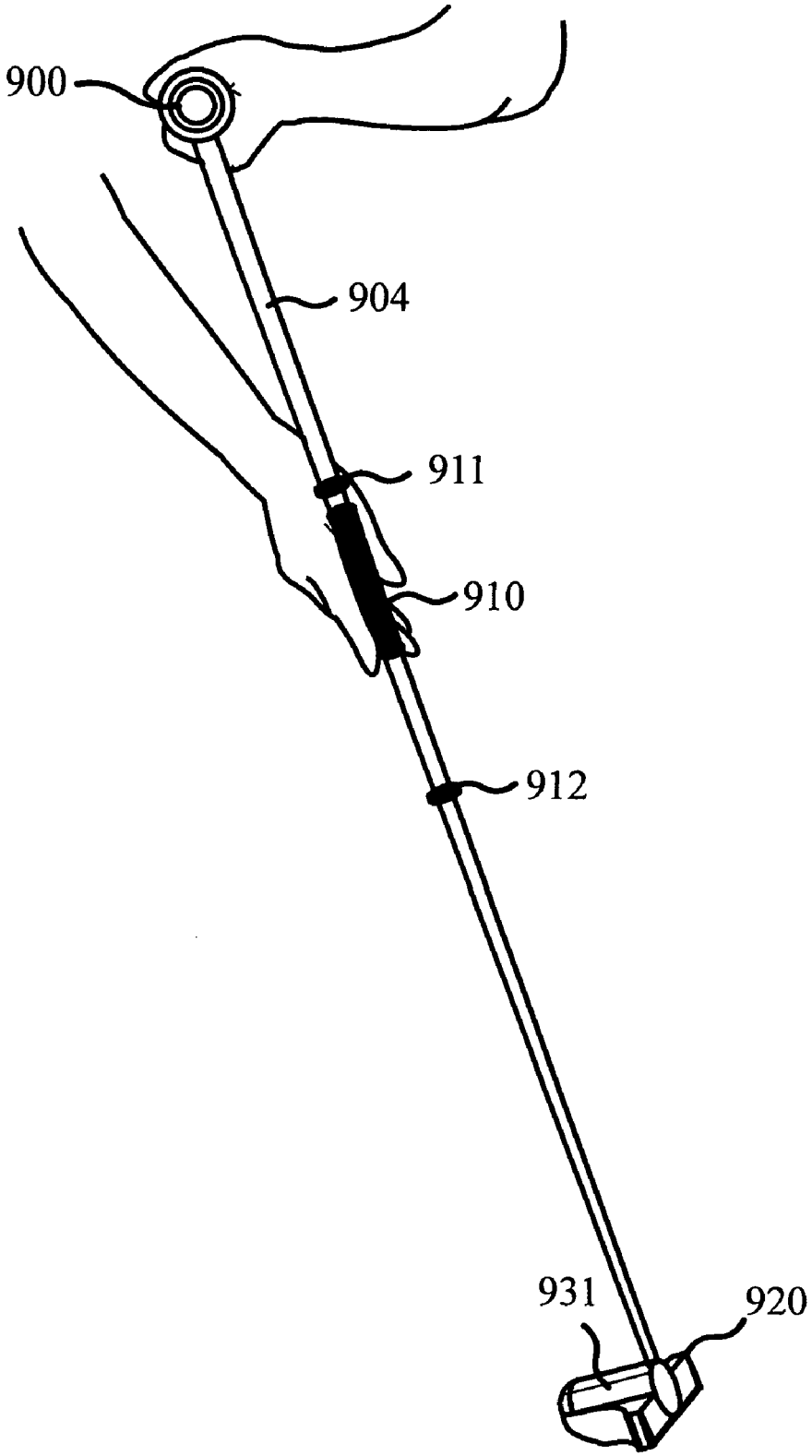

FIGS. 9A through 9C illustrates exemplary views of using the improved putter. Referring to FIG. 9A, a golfer grips the handle 900 with one hand and slidable grip 910 with the other hand. The hand holding the handle 900 can be positioned toward the end of the handle 900 so as not to impede the eyesight of the golfer to the putter head and golf ball. The putter head 920 can have a marking 931 (straight line) across the top of the head to assist the golfer with the target line for striking the golf ball. In this example, the slidable grip 910 is in between the stop parts 911 and 912.

Referring to FIG. 9B, the golfer can move the shaft back during the back swing where the slidable part 910 can slide to the bottom stop part 912. Because the shaft 904 can rotate or pivot with respect to the handle 900, the shaft 904 and putter head 920 can have a pendulum motion and the hand on the handle 900 can stay in a fixed position. Referring to FIG. 9C, at the end of the back swing, the golfer can begin the down swing to strike the ball. During this part of the swing, the slidable part 910 can move towards the upper stop part 911. This allows the user hand to maintain a more nature movement of the arm and maintain alignment accuracy when striking the ball. Because of the pendulum motion of the putter head 920 and shaft 904, the putter head 920 hits the golf ball along a target line with less deviation from that line.

Figure 10:
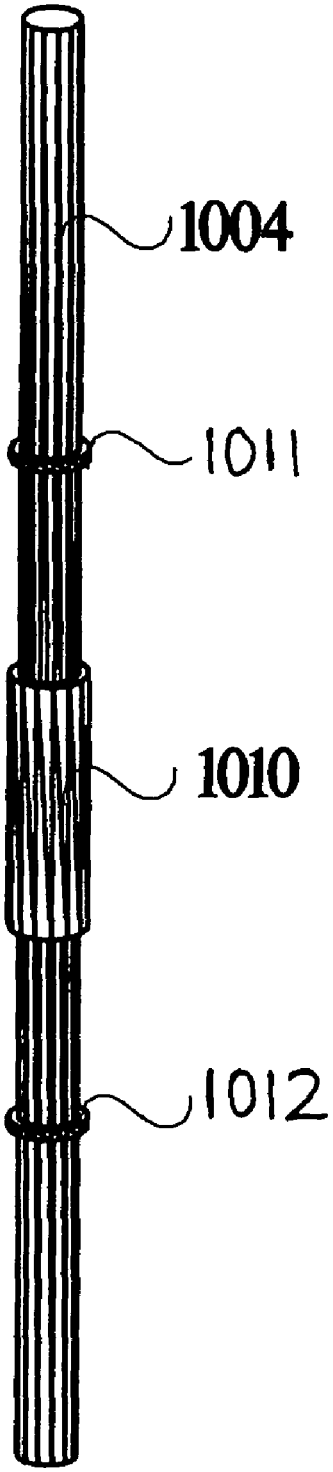
FIG. 10 illustrates an example perspective view of the shaft and slidable grip of the improved putter with coverings.

FIG. 10 illustrates an example perspective of the shaft 1004 and slidable grip 1010 of the improved putter with coverings. The shaft 1004 can have a covering over a stainless steel shaft or nickel chrome shaft, e.g., a smooth and hard plastic covering where the inside of the slidable part 1010 is also a smooth and hard plastic such that the surfaces within the slidable part 1010 and shaft 1004 have low friction and move readily easy. In other examples, the shaft 1004 is stainless steel or nickel chrome and the slidable part 1010 is made of a rubber, plastic, or composite material that easily glides on the stainless steal. Other type of metal materials can also be used for shaft 1004. In other examples, any different combinations of materials can be used when forming the slidable shaft 1010 and shaft 1004. The stop parts 1011 and 1012 can be washer shaped hard or soft plastic or rubber. In certain examples, these stop parts can easily slide up or down the shaft 1004. In other examples, the stop parts can be glued or screwed into the shaft.

Figure 11:
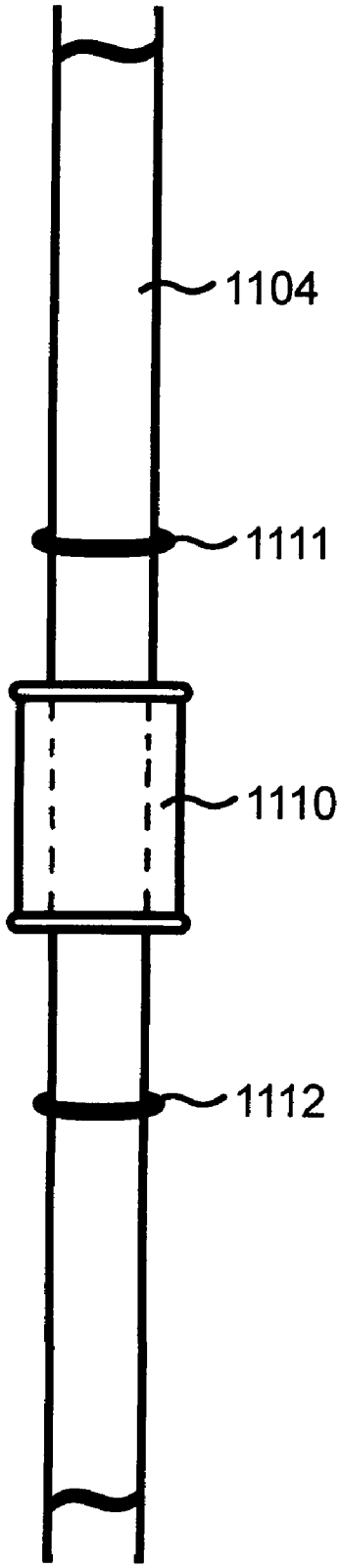
FIG. 11 illustrates an example perspective view of the shaft and slidable grip of the improved putter with the coverings removed.

FIG. 11 illustrates an example perspective of the shaft 1104 and slidable grip 1110 of the improved putter with the coverings removed. In this example, the slidable part 1110 can be made of a metallic material and capable of sliding on the shaft 1104, which is also composed of a metallic material. The stop parts 1111 and 1112 can prevent the slidable part 1110 from moving past desired locations of the shaft 1104. The shaft 1004 and 1104 in FIGS. 10 and 11 can telescope into varying and adjustable lengths. For example, the shafts 1004 and 1104 can be made of multiple tubes or cylinders placed inside one another, which can telescope into varying length shafts.

Figure 12A:
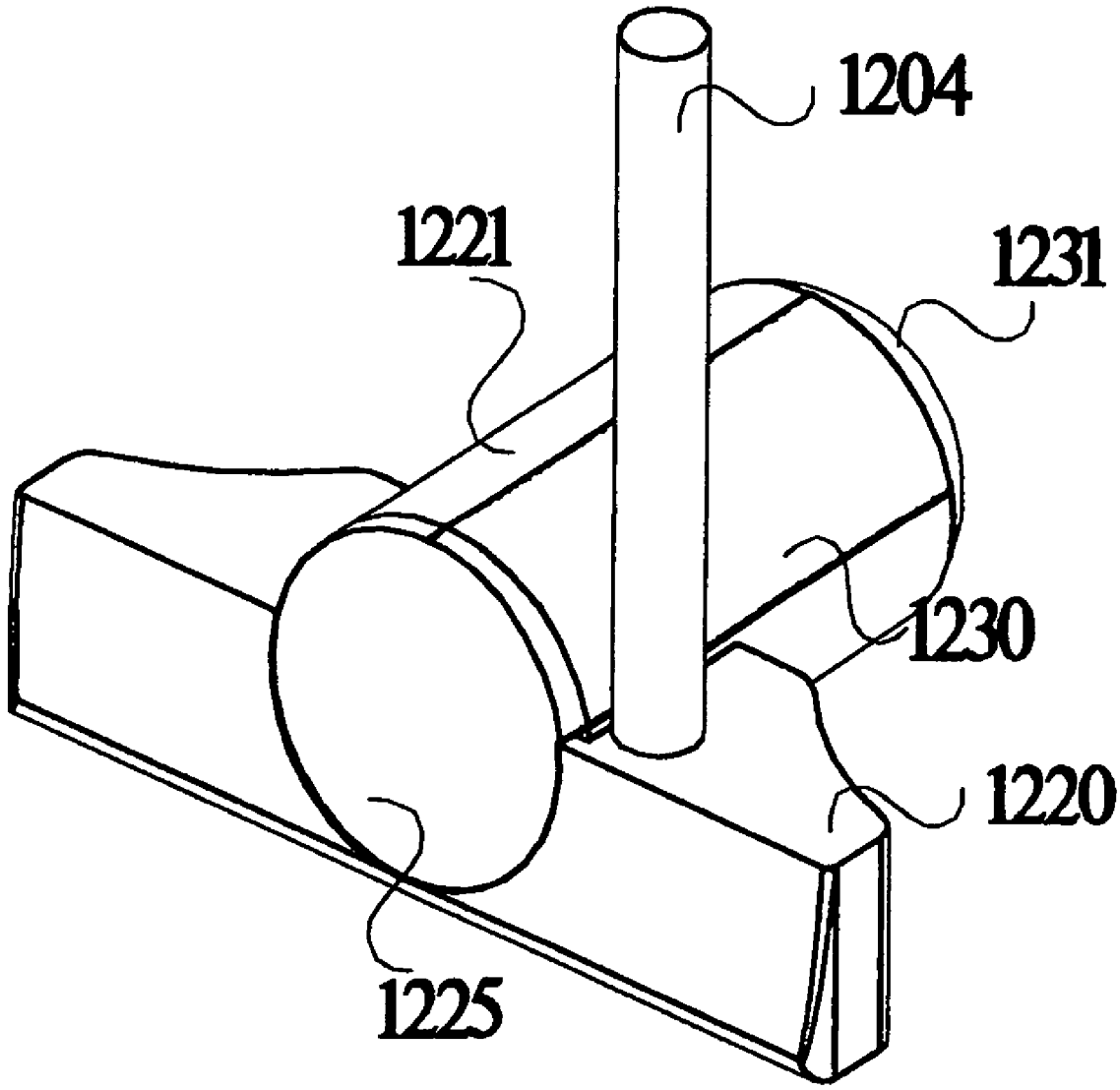
FIGS. 12A and 12B illustrate exemplary front and back perspective views, respectively, of a putting head for the improved putter.
Figure 12B:
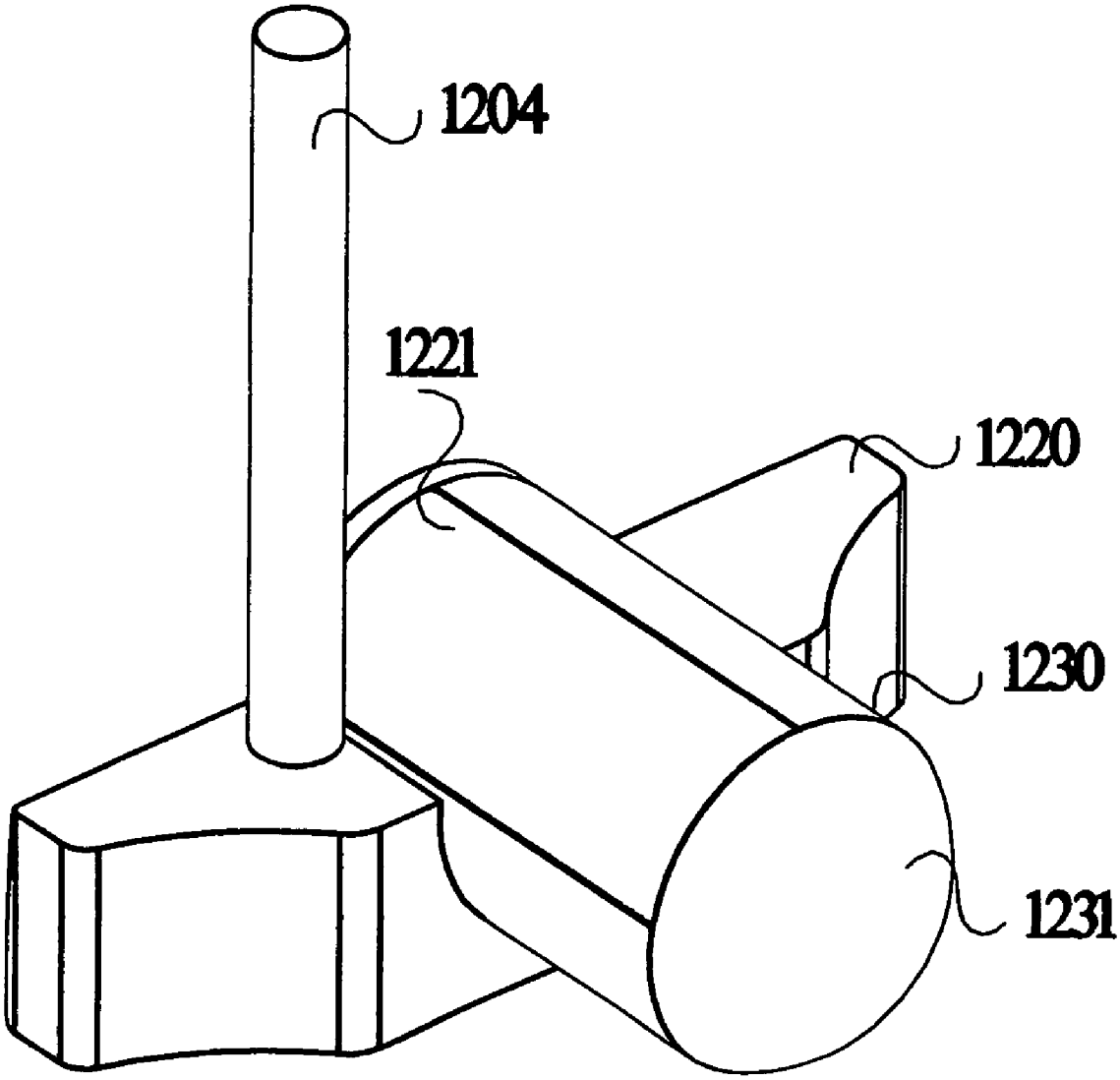

FIGS. 12A and 12B illustrate exemplary perspectives of the front and back views, respectively, of a putting head for the improved putter. Referring to FIG. 12A, the putting head 1220 is connected with the shaft 1204 having a golf ball size open face area 1125 to strike a golf ball. The putting head 1220 includes a conical part 1230 with a dome end 1231, which provides a balanced weighting for the pendulum motion. The shaft 1204 is attached near the conical part 1230 for a more balanced pendulum motion. The conical part 1230 has a straight line marking on the top so a golfer can use that marketing to line up the golf ball to the target.

Figure 13:
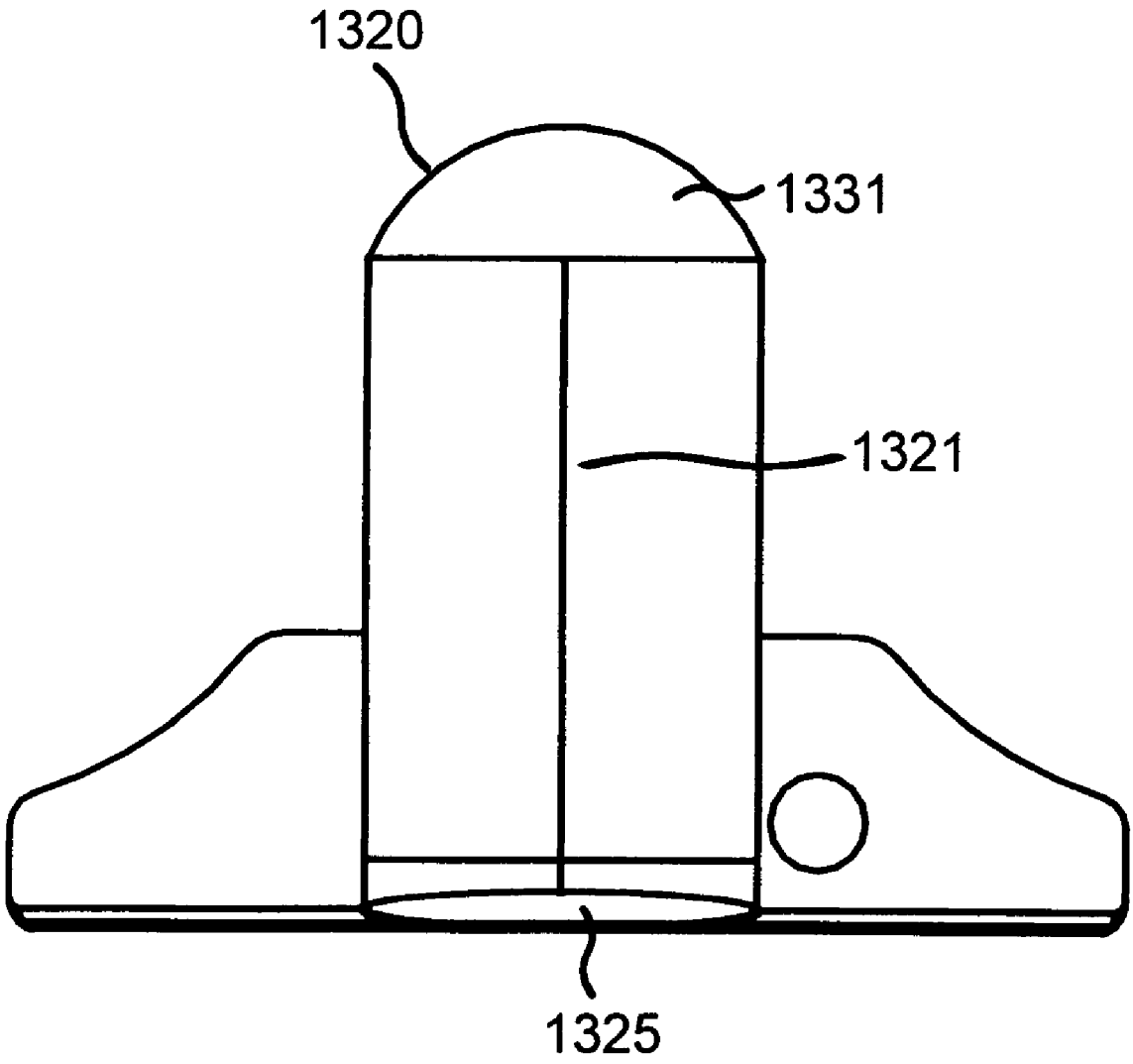
FIG. 13 illustrates an exemplary top view of a putting head of the improved putter.

FIGS. 13-16 illustrate exemplary top and side views of a putting head of the improved putter. These putting heads can be used for the above examples for the improved putter. Referring to FIG. 13, a top view of a putting head 1320 is shown, which is a top of the putting head of FIGS. 12A and 12B. This is the view that is seen by a golfer when aligning his golf ball with the putter. There is longitudinal line 1321 running from the semi conical end to the front face 1325 of the putting head 1320. The golfer can use that alignment line for his target line. This target line can be the direction of the pendulum motion of the putting head 1320 for the improved putter. When the golfer strikes the ball when the putting head 1320 using a pendulum motion following the target line, the ball can follow the target line into the hole.

Figure 14:
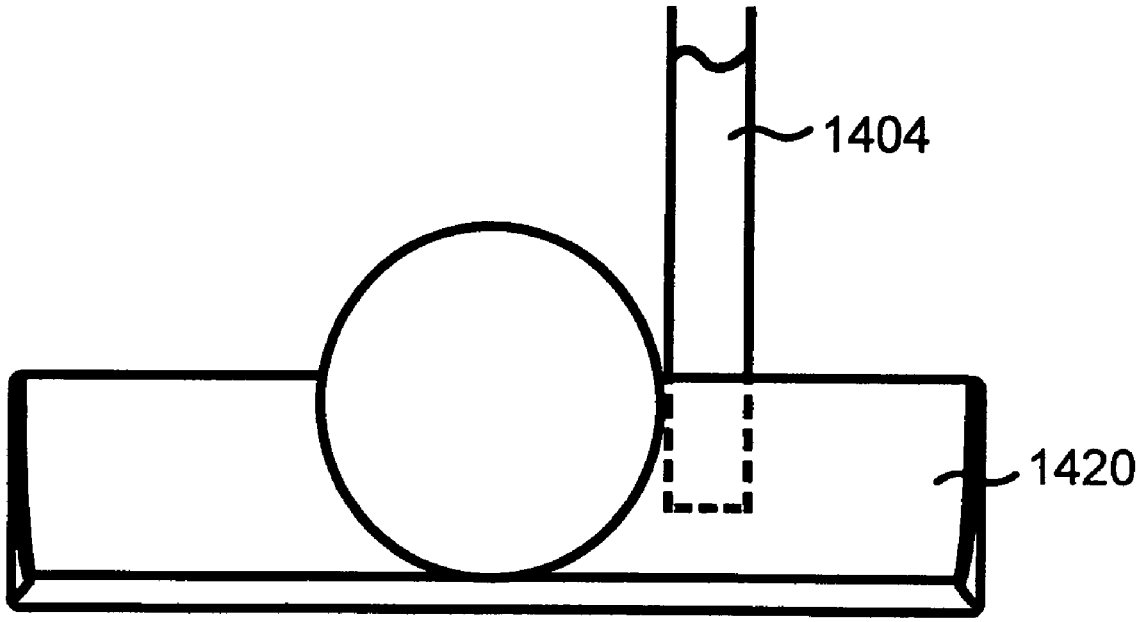
FIG. 14 illustrates an exemplary side view of a putting head of the improved putter.
Figure 15:
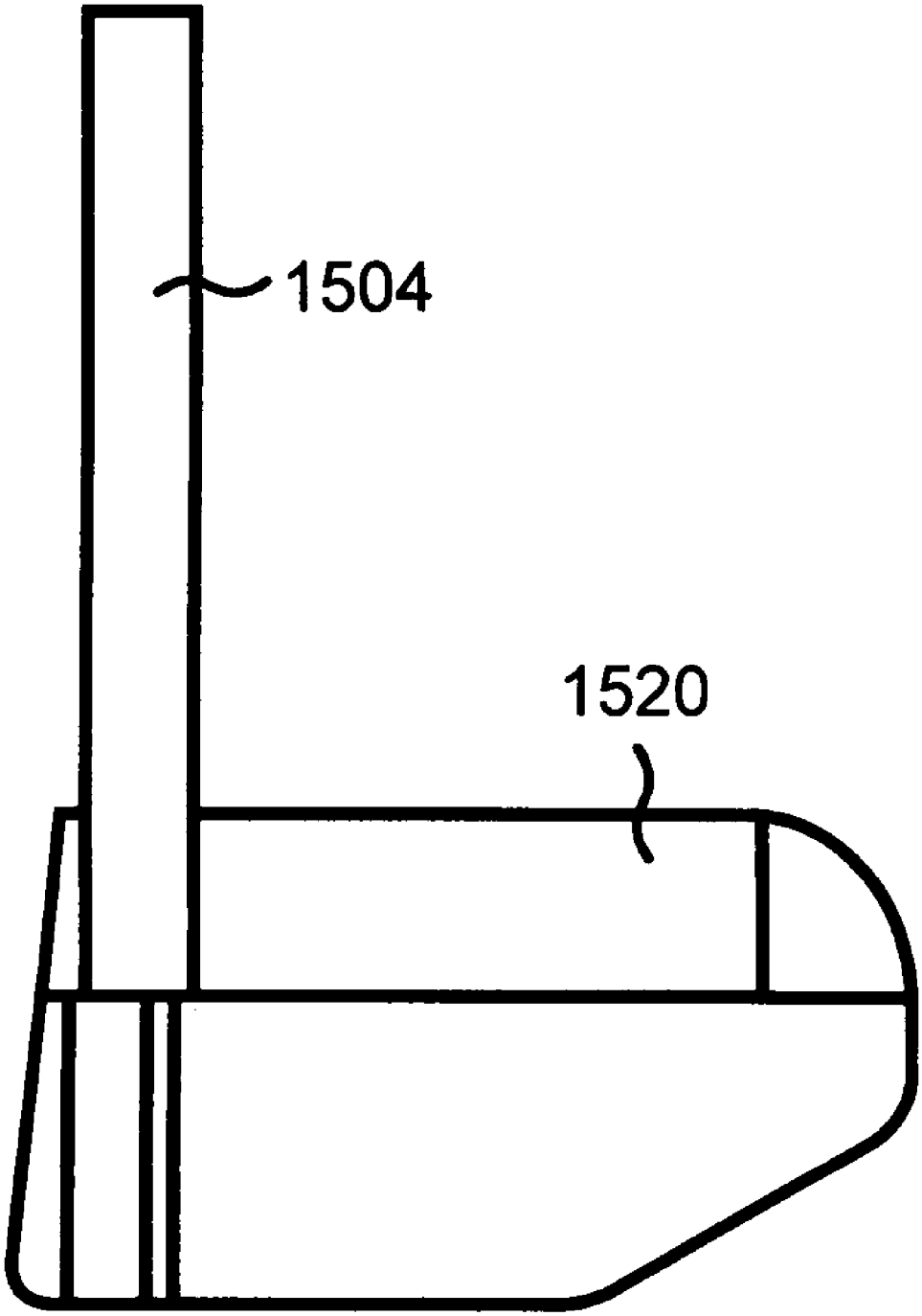
FIG. 15 illustrates an exemplary side view of a putting head of the improved putter.
Figure 16:
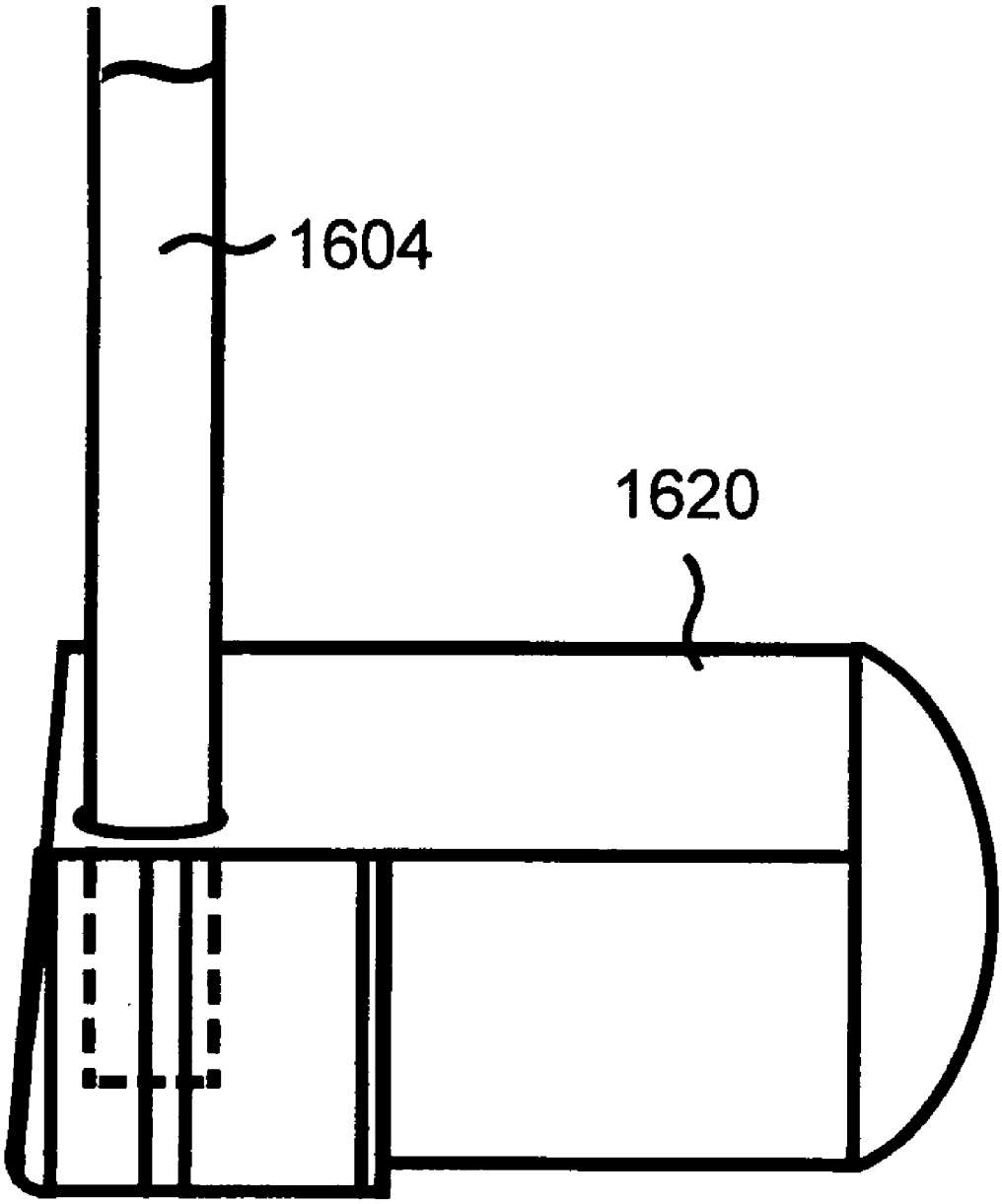
FIG. 16 illustrates an exemplary side view of a putting head of the improved putter.

FIGS. 14, 15, and 16 provide alternative shapes of a putting head for the improved putter. Referring to FIG. 14, a putting head 1420 and shaft 1404 can take on more conventional style of a putter, however, striking the ball in a pendulum motion. Referring to FIG. 15, a putting head 1520 can have more of a wedge shape and the shaft 1504 can be position near a side of the putting head 1520. Referring to FIG. 16, the putting head 1620 can have a half of a conical shape where the putting head is shaped like a cylindrical cone with the top half removed. The shaft in this example is connected to the putting head near a front edge. Any number of putting head shapes can be implemented and shaft connections to the putting head for the improved putter.

Thus, the improved putter has been described that overcomes disadvantages of conventional putters and improves the putting accuracy for a golfer. In the foregoing specification, the invention has been described with reference to specific examples and embodiments. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. A putter comprising:

an adjustable handle configured for a first position and a second position wherein an axis of said handle at said first position is at a different angle with an axis of a shaft than said axis of said handle at a second position;

the shaft connected with the adjustable handle at an end of said shaft and configured to rotate about the handle as the handle is kept entirely stationary;

a putter head connected with the shaft and configured to move in a pendulum motion as the shaft rotates about the handle; and a slidable hand grip configured to slide longitudinally along part of the shaft as the shaft rotates about the handle.

2. The putter of claim 1, wherein the adjustable handle is at the first position if the adjustable handle is positioned substantially perpendicular with the shaft.

3. The putter of claim 2, wherein the adjustable handle is at the second position if the adjustable handle is positioned vertically with respect to the shaft.

4. The putter of claim 3, further comprising:

a first pivoting mechanism to allow the adjustable handle to move between the first position and second position; and a second pivoting mechanism to allow the shaft to rotate about the handle.

5. The putter of claim 4, wherein the first pivoting mechanism includes:

first and second lateral parts connected by a rod; and a center part positioned between the first and second lateral parts and configured to pivot about the rod.

6. The putter of claim 5, further comprising:

a first stop part to stop movement of the slidable grip in one direction and second stop part to stop movement of the slidable grip in a second direction.

7. The putter of claim 6, wherein the first and second stop parts are adjustable.

8. A putter comprising:

a handle;

a shaft connected with the handle at an end of said shaft and configured to pivot about the handle as the handle is kept entirely stationary;

a slidable hand grip configured to slide longitudinally along part of the shaft as the shaft pivots about the handle said handle configured for a first position and a second position wherein an axis of said handle at said first position is at a different angle with an axis of said shaft than said axis of said handle at a second position; and a head connected with the shaft and configured to move in a pendulum motion.

9. The putter of claim 8, wherein the handle adjusts to the first position that is substantially perpendicular with the shaft.

10. The putter of claim 9, wherein the handle adjusts to the second position that is vertical with respect to the shaft.

11. The putter of claim 10, further comprising:

a first pivoting mechanism that adjusts the handle between the first position and second position.

12. The putter of claim 11, wherein the first pivoting mechanism includes:

first and second lateral parts connected by a rod; and a central part positioned between the first and second lateral parts and configured to pivot about the rod.

13. The putter of claim 12, further comprising:

a second pivoting mechanism that allows the shaft to pivot about the handle.

14. The putter of claim 8, further comprising:

a first stop part to stop movement of the slidable grip in one direction and second stop part to stop movement of the slidable grip in a second direction.

15. The putter of claim 14, where the first and second stop parts are adjustable along the shaft.

16. A putter comprising:

a handle;

a shaft connected with the handle at an end of said shaft, wherein the handle is positioned substantially perpendicular with respect to the shaft;

a head connected with the shaft;

a pivoting mechanism configured to allow the shaft to pivot about the handle and to move the head in a pendulum motion as the handle is kept entirely stationary, and wherein the pivoting mechanism is positioned along an axis aligned vertically with the shaft; and a slidable hand grip configured to slide longitudinally along part of the shaft as the head moves in a pendulum motion.

* * * * *